US010315320B2

(12) United States Patent
Narita et al.

(10) Patent No.: US 10,315,320 B2
(45) Date of Patent: Jun. 11, 2019

(54) ELECTRIC SHAVER

(71) Applicant: Panasonic Intellectual Property Management Co., Ltd., Osaka (JP)

(72) Inventors: Kenji Narita, Osaka (JP); Shigeru Tatsuta, Osaka (JP); Shigetoshi Sakon, Osaka (JP); Satoshi Nakayama, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 77 days.

(21) Appl. No.: 14/426,059

(22) PCT Filed: Dec. 4, 2013

(86) PCT No.: PCT/JP2013/007119
§ 371 (c)(1),
(2) Date: Mar. 4, 2015

(87) PCT Pub. No.: WO2014/091719
PCT Pub. Date: Jun. 19, 2014

(65) Prior Publication Data

US 2015/0224653 A1 Aug. 13, 2015

(30) Foreign Application Priority Data

Dec. 13, 2012 (JP) ..... 2012-272028

(51) Int. Cl.
*B26B 19/04* (2006.01)
*B26B 19/12* (2006.01)
*B26B 19/14* (2006.01)

(52) U.S. Cl.
CPC ..... *B26B 19/12* (2013.01); *B26B 19/04* (2013.01); *B26B 19/044* (2013.01); *B26B 19/141* (2013.01)

(58) Field of Classification Search
CPC ..... B26B 19/12; B26B 19/04; B26B 19/141; B26B 19/044; B26B 19/042; B26B 19/046; B26B 19/048; B26B 19/42
See application file for complete search history.

(56) References Cited

U.S. PATENT DOCUMENTS 3,088,205 A * 5/1963 Ellis ..... B26B 19/42 30/34.05
3,092,904 A * 6/1963 Bruecker ..... B26B 19/044 30/34.1

(Continued)

FOREIGN PATENT DOCUMENTS

CN 2494147 Y 6/2002
CN 101195223 A 6/2008

(Continued)

OTHER PUBLICATIONS

Chinese Office Action issued in Chinese Application No. 201380046226.9 dated Sep. 22, 2015, with English Translation of Search Report.

(Continued)

*Primary Examiner* — Jonathan G Riley
(74) *Attorney, Agent, or Firm* — McDermott Will & Emery LLP

(57) ABSTRACT

This electric shaver has outer blades, inner blades, an inner-blade joint component, and skin-entry prevention parts. The outer blades have outer-blade holes. The inner blades have main inner-blade walls, multiple blade pieces, inner-blade holes, and internal inner-blade spaces. The inner blades move back and forth relative to the outer blades so as to cut hair that has entered through the outer-blade holes. The main inner-blade walls are connected to the inner-blade joint component. The internal inner-blade spaces are bounded by the main inner-blade walls and the multiple blade pieces. The skin-entry prevention parts are located (Continued)

inside the internal inner-blade spaces, at positions that correspond to the inner-blade holes, and are structured so as to contact skin that has entered the internal inner-blade spaces via the inter-blade holes.

14 Claims, 15 Drawing Sheets

(56) References Cited

U.S. PATENT DOCUMENTS

| | | | | |
|---|---|---|---|---|
| 3,834,017 | A | 9/1974 | Tolmie | |
| 6,868,611 | B2 * | 3/2005 | Geertsma | B26B 19/143 30/346.51 |
| 2002/0059729 | A1 * | 5/2002 | Ikuta | B26B 19/04 30/43.91 |
| 2008/0016694 | A1 * | 1/2008 | Sato | B26B 19/04 30/43.92 |
| 2008/0134515 | A1 | 6/2008 | Sato et al. | |
| 2009/0133265 | A1 | 5/2009 | Burghardt et al. | |
| 2009/0307909 | A1 | 12/2009 | Sato et al. | |
| 2010/0011587 | A1 | 1/2010 | Obermann et al. | |

FOREIGN PATENT DOCUMENTS

| | | | | |
|---|---|---|---|---|
| CN | 101522378 | A | 9/2009 | |
| DE | 102009031626 | A1 * | 1/2011 | B26B 19/044 |
| JP | 56-72568 | U | 6/1981 | |
| JP | 59-77882 | A | 5/1984 | |
| JP | 59-101181 | A | 6/1984 | |
| JP | 60-155466 | U | 10/1985 | |
| JP | S58-003160 | U | 6/1991 | |
| JP | 10-118358 | A | 5/1998 | |
| JP | 2004-016530 | A | 1/2004 | |
| JP | 2009-502278 | A | 1/2009 | |
| WO | 2008-010431 | A1 | 1/2008 | |
| WO | 2011/001395 | A1 | 1/2011 | |
| WO | 2011/001404 | A1 | 1/2011 | |
| WO | WO 2011001404 | A1 * | 1/2011 | B26B 19/042 |

OTHER PUBLICATIONS

English Translation of International Preliminary Report on Patentability issued in International Application No. PCT/JP2013/007119 dated Jun. 16, 2015.

International Search Report issued in PCT/JP2013/007119, dated Mar. 11, 2014, with English translation.

Extended European Search Report issued in European Application No. 13863410.0 dated Mar. 14, 2016.

Japanese Office Action dated Jun. 6, 2017 issued in Japanese Patent Application No. 2014-551879 (with English translation).

Japanese Office Action dated Jan. 9, 2018 issued in Japanese Patent Application No. 2013-251336 (with English translation).

* cited by examiner

ELECTRIC SHAVER

RELATED APPLICATIONS

This application is the U.S. National Phase under 35 U.S.C. § 371 of International Application No. PCT/JP2013/007119, filed on Dec. 4, 2013, which in turn claims the benefit of Japanese Application No. 2012-272028, filed on Dec. 13, 2012, the disclosures of which Applications are incorporated by reference herein.

TECHNICAL FIELD

The present invention relates to an electric shaver.

BACKGROUND ART

Patent Document 1 discloses an example of an electric shaver. The electric shaver in Patent Document 1 includes a driving unit, an outer blade, and an inner blade. FIG. 27 illustrates an electric shaver 1000 of Patent Document 1. The driving unit is not shown in FIG. 27.

The electric shaver 1000 includes an outer blade 1010 and an inner blade 1020. The outer blade 1010 is pressed against a skin 1030. The outer blade 1010 includes an outer blade hole 1011. Facial hair 1040 growing on the skin 1030 enters the outer blade hole 1011. The inner blade 1020 is positioned in the outer blade 1010. The inner blade 1020 is driven by the driving unit to move back and forth in a sideward direction of the outer blade 1010. The inner blade 1020 includes an inner blade hole 1021. The inner blade 1020 cuts the facial hair 1040 drawn into the inner blade hole 1021 through the outer blade hole 1011.

PRIOR ART DOCUMENT

Patent Document

Patent Document 1: Japanese National Phase Laid-Open Patent Publication No. 2009-502278

SUMMARY OF THE INVENTION

Problems to be Solved by the Invention

The skin 1030 may enter the inner blade hole 1021 through the outer blade hole 1011. The skin 1030 drawn into the inner blade hole 1021 is caught between the outer blade 1010 and the inner blade 1020 when the inner blade 1020 moves back and forth relative to the outer blade 1010. This irritates the skin 1030. The same problem occurs when using a rotary electric shaver.

It is an object of the present invention to provide an electric shaver that is less likely to irritate the skin.

Means for Solving the Problems

One aspect of the present invention is an electric shaver including an outer blade, an inner blade, an inner blade joint component, and a skin guard. The outer blade includes an outer blade hole. The inner blade includes an inner blade main body wall, a plurality of blade pieces, an inner blade hole, and an inner blade internal space. The inner blade rotates or moves back and forth relative to the outer blade to cut hair drawn in through the outer blade hole. The inner blade main body wall is coupled to the inner blade joint component. The inner blade internal space is surrounded by the inner blade main body wall and the plurality of blade pieces. The skin guard is located in the inner blade internal space at a position corresponding to the inner blade hole, and the skin guard comes into contact with the skin that enters the inner blade internal space through the inner blade hole.

The skin guard is formed in the inner blade internal space at a position corresponding to the inner blade hole. The skin guard comes into contact with the skin that enters the inner blade internal space through the inner blade hole. This restricts entry of the skin into the inner blade internal space through the inner blade hole or reduces the amount of skin that enters the inner blade hole. Thus, an electric shaver that is less likely to irritate the skin can be provided.

In one embodiment, the skin guard includes a guard base and a guard contact portion. The guard base is coupled to the inner blade joint component or the inner blade main body wall and supports the guard contact portion. The guard contact portion is shaped to extend toward the inner blade hole and is located closer to the inner blade internal space than a distal end of the inner blade or is located between the outer blade and the distal end of the inner blade.

In one embodiment, the guard contact portion includes a portion open at an inner blade hole side.

In one embodiment, the skin guard includes a guard elastic portion. The guard elastic portion is located between the guard base and the guard contact portion, the guard elastic portion is supported by the guard base, and the guard elastic portion supports the guard contact portion.

In one embodiment, the guard contact portion is formed from an elastic material.

In one embodiment, suspension force of the skin guard is larger than suspension force of the outer blade and suspension force of the inner blade.

In one embodiment, the electric shaver further includes at least one of a skin-entry amount detector and a pressing force detector, and a control unit. The skin-entry amount detector detects a skin-entry amount indicating an amount of the skin that is drawn into the inner blade hole through the outer blade hole, and the skin-entry amount detector provides the control unit with a skin-entry amount detection signal corresponding to the detected skin-entry amount. The pressing force detector detects pressing force indicating pressure applied to the outer blade when the outer blade comes into contact with the skin, and the pressing force detector provides the control unit with a pressure detection signal corresponding to the detected pressing force. The control unit moves a distal end of the skin guard toward the inner blade hole in accordance with at least one of the skin-entry amount detection signal that indicates an increase in the skin-entry amount and the pressure detection signal that indicates an increase in the pressing force.

In one embodiment, the electric shaver further includes an oscillator that oscillates the skin guard.

In one embodiment, the skin guard includes a rotating portion that rotates when contacting the skin.

In one embodiment, the skin guard is located in the inner blade internal space at a position corresponding to at least two of the plurality of inner blade holes.

In one embodiment, the inner blade includes a longitudinal high pressure portion, which contacts the skin with a high pressure, and a longitudinal low pressure portion, which contacts the skin with a lower pressure than the longitudinal high pressure portion, in a longitudinal direction of the inner blade joint component. The skin guard is located in the inner blade internal space at a position corresponding to the longitudinal high pressure portion.

In one embodiment, the skin guard is one of a plurality of skin guards arranged in a lateral direction of the inner blade joint component in the inner blade internal space.

In one embodiment, the inner blade includes a lateral high pressure portion, which contacts the skin with a high pressure, and a lateral low pressure portion, which contacts the skin with a lower pressure than the lateral high pressure portion, in a lateral direction of the inner blade joint component. The skin guard is located in the inner blade internal space at a position corresponding to the lateral high pressure portion.

In one embodiment, the skin guard is similar in shape to the inner blade.

In one embodiment, the skin guard is formed integrally with the inner blade.

DESCRIPTION OF THE EMBODIMENTS

First Embodiment

Figure 1:
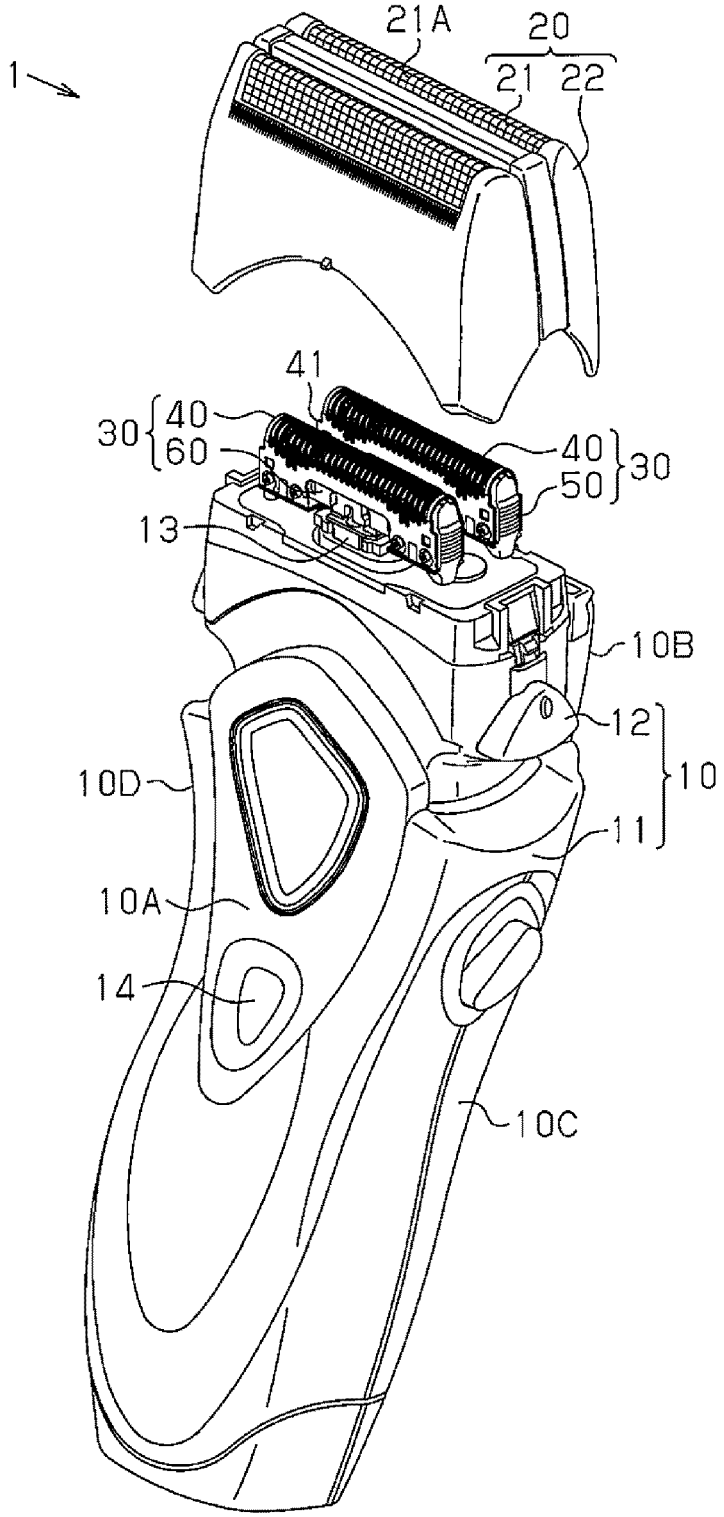
FIG. 1 is an exploded perspective view of an electric shaver according to a first embodiment.

A configuration of an electric shaver 1 will now be described with reference to FIG. 1.

The electric shaver 1 includes a shaver main body 10, an outer blade unit 20, and two inner blade units 30. The electric shaver 1 is formed as a reciprocating electric shaver in which the inner blade unit 30 moves back and forth relative to the outer blade unit 20.

The shaver main body 10 includes a grip 11, a head 12, a driving unit 13, and a power switch 14. The shaver main body 10 includes a main body front surface 10A, a main body back surface 10B, a main body right surface 10C, and a main body left surface 10D. A main body longitudinal direction, a main body sideward direction orthogonal to the main body longitudinal direction, and a main body depth direction orthogonal to the main body longitudinal direction and the main body sideward direction are defined based on the shaver main body 10.

The main body front surface 10A faces a user when the user uses the electric shaver 1. The main body back surface 10B is on the opposite side of the main body front surface 10A in the main body depth direction. The main body right surface 10C is on the right side of the main body front surface 10A in the main body sideward direction. The main body left surface 10D is on the left side of the main body front surface 10A in the main body sideward direction.

The head 12 is coupled to the grip 11. The driving unit 13 is accommodated in the grip 11 and the head 12. The driving unit 13 partially protrudes out of the head 12. The driving unit 13 moves the inner blade unit 30 back and forth in the main body sideward direction. The power switch 14 is formed on the main body front surface 10A of the grip 11.

The outer blade unit 20 includes an outer blade 21 and an outer blade casing 22. The outer blade 21 is coupled to the outer blade casing 22. The outer blade 21 has a suspension function for absorbing pressure applied in the main body longitudinal direction. The outer blade 21 includes outer blade holes 21A. Facial hair of the user enters a space in the outer blade casing 22 through the outer blade holes 21A. The outer blade holes 21A are formed over the entire outer blade 21. The outer blade casing 22 is coupled to the shaver main body 10.

Figure 2:
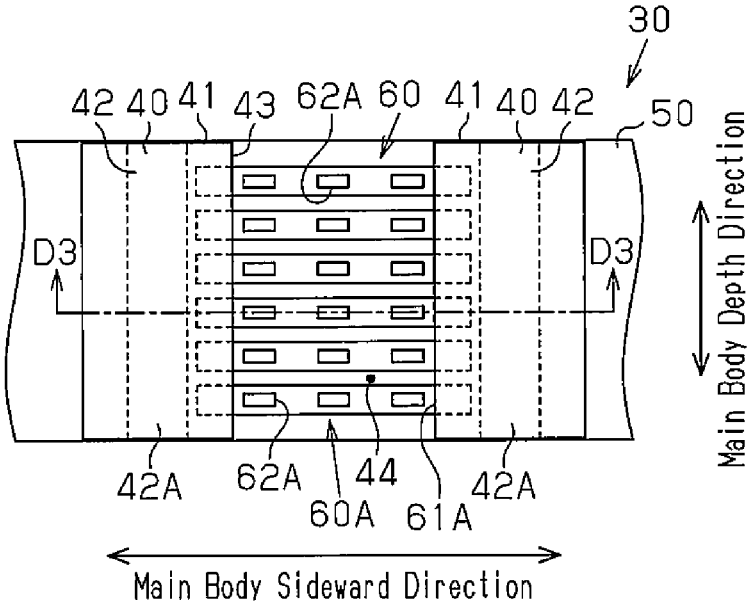
FIG. 2 is a plan view of an inner blade unit according to the first embodiment.

The inner blade unit 30 includes an inner blade 40, an inner blade joint component 50, and a skin guard 60 (see FIG. 2). The inner blade joint component 50 couples the inner blade unit 30 to the driving unit 13. The inner blade unit 30 moves back and forth relative to the outer blade unit 20 to cut the hair. The inner blade 40 includes an inner blade main body wall 41. The inner blade main body wall 41 is coupled to the inner blade joint component 50. The inner blade 40 has a suspension function for absorbing pressure applied in the main body longitudinal direction.

The configuration of the inner blade unit 30 will now be described in detail with reference to FIG. 2. FIG. 2 schematically illustrates a portion of adjacent blade pieces 42 in the inner blade unit 30.

The inner blade 40 is formed from a metal material. The inner blade 40 includes the inner blade main body wall 41 and a plurality of the blade pieces 42. An inner blade hole 43 is formed between adjacent blade pieces 42. The inner blade main body wall 41 and the plurality of blade pieces 42 are integrally formed from the same material. The inner blade 40 moves back and forth together with the inner blade joint component 50 in the main body sideward direction to cut the facial hair.

The plurality of blade pieces 42 are arranged in the main body sideward direction. The inner blade main body wall 41 and the plurality of blade pieces 42 form an inner blade internal space 44. Facial hair enters the inner blade hole 43. The inner blade joint component 50 is formed from a resin material.

The configuration of the skin guard 60 will now be described with reference to FIG. 3.

The skin guard 60 is formed from a resin material. Entrance of the skin into the inner blade internal space 44 is restricted when the skin guard 60 comes into contact with the skin through the inner blade hole 43 (hereinafter, referred to as "skin entry restriction function"). The skin guard 60 is located in the inner blade internal space 44 at a position corresponding to the inner blade hole 43. In the illustrated example, a plurality of the skin guards 60 are located at positions corresponding to the inner blade holes 43 in the main body sideward direction. The skin guard 60 includes a guard base 61 and a guard contact portion 62. The guard base 61 and the guard contact portion 62 are integrally formed from the same material.

The guard base 61 is coupled to the inner blade joint component 50. For example, the guard base 61 has a rectangular parallelepiped shape. The guard base 61 supports the guard contact portion 62.

The guard contact portion 62 has a shape that extends from the guard base 61 toward the inner blade hole 43. The guard contact portion 62 comes into contact with the skin that enters the inner blade internal space 44 through the inner blade hole 43. The guard contact portion 62 is located toward an inner blade internal space side from a distal end surface 42A of the blade piece 42. The guard contact portion 62 includes a plurality of openings 62A arranged in the main body sideward direction and the main body depth direction. Facial hair enters the inner blade internal space 44 through the plurality of openings 62A. The plurality of openings 62A are formed in portions of the guard contact portion 62*s* at the inner blade hole side.

The operation of the electric shaver 1 will now be described with reference to FIG. 1 and FIG. 4.

Figure 4A:
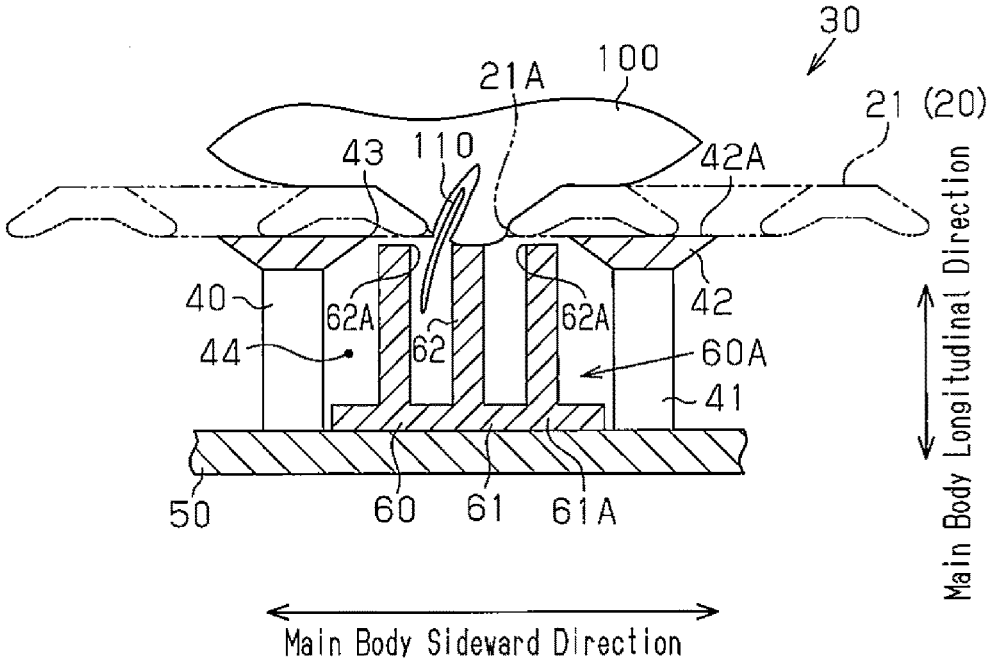
FIG. 4A is a cross-sectional view illustrating a state in which skin and facial hair have entered an inner blade internal space in the inner blade unit of the first embodiment.

As illustrated in FIG. 4A, the user presses the outer blade 21 against the skin 100. Facial hair 110 enters the inner blade internal space 44 through the outer blade hole 21A and the inner blade hole 43. The skin 100 enters the inner blade hole 43 through the outer blade hole 21A. At this point, the skin 100 comes into contact with the guard contact portion 62 of the skin guard 60. The driving unit 13 illustrated in FIG. 1 moves the inner blade unit 30 back and forth relative to the outer blade unit 20 in the main body direction sideward direction, while the power switch 14 is ON.

Figure 4B:
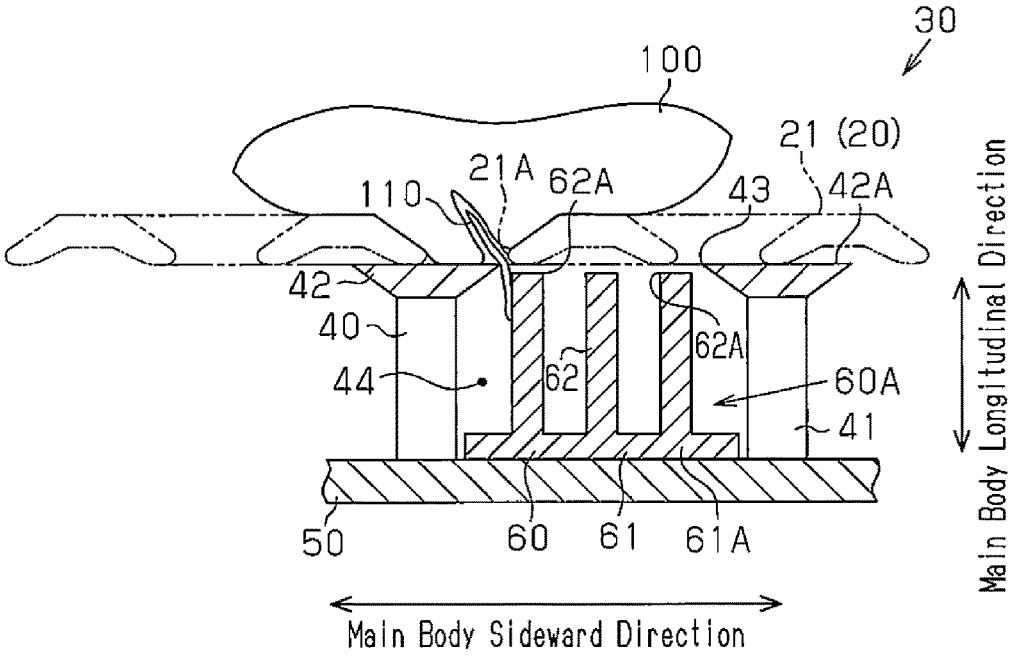
FIG. 4B is a cross-sectional view illustrating a state in which the inner blade is cutting the facial hair.

As illustrated in FIG. 4B, the blade piece 42 of the inner blade 40 cooperates with the outer blade 21 to catch the facial hair 110 drawn through the outer blade hole 21A of the outer blade unit 20. Thus, the facial hair 110 is cut.

The electric shaver 1 according to the first embodiment has the following advantages.

(1) The skin guard 60 comes into contact with the skin 100 drawn into the inner blade internal space 44 through the inner blade hole 43. Thus, the skin is prevented from entering the inner blade internal space 44 through the inner blade hole 43 or the amount of skin 100 entering the inner blade hole 43 and the inner blade internal space 44 is reduced. As a result, the electric shaver 1 is less likely to irritate the skin 100.

(2) The guard contact portion 62 is located toward the inner blade internal space side from the distal end surface 42A of the blade piece 42. Thus, the blade piece 42 can more efficiently cooperate with the outer blade 21 to cut the facial hair 110, compared with a configuration in which the distal end surface 42A of the blade piece 42 is located toward the inner blade internal space side from the guard contact portion 62.

(3) With the guard contact portion 62, the facial hair 110 can efficiently enter the inner blade internal space 44 through the plurality of openings 62A.

Figure 3:
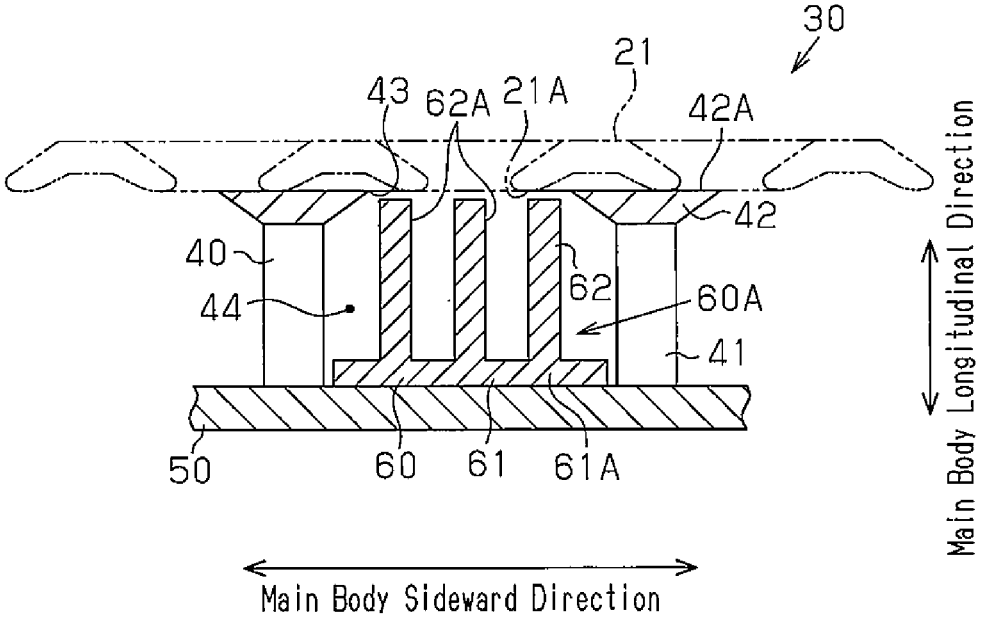
FIG. 3 is a cross-sectional view taken along a line D3-D3 in FIG. 2.

In the example illustrated in FIG. 3, the skin guard 60 includes the guard base 61 and the plurality of guard contact portions 62. A single guard contact portion 62 and a guard base 61A serving as a part of the guard base 61 supporting the guard contact portion 62 form a skin guard 60A as a basic element of the skin guard 60. For example, three skin guards 60A are arranged in the main body sideward direction. The guard bases 61A of the adjacent skin guards 60 are coupled with each other to form the guard base 61. The guard bases 61A of the plurality of skin guards 60A are coupled with each other. This forms a single skin guard 60, which is larger than each skin guard 60A.

Second Embodiment

An electric shaver 1 according to a second embodiment differs from the electric shaver 1 according to the first embodiment in the following point but is otherwise the same. The inner blade unit 30 according to the first embodiment includes the skin guard 60 illustrated in FIG. 3 and the like. The inner blade unit 30 according to the second embodiment includes a skin guard 260 illustrated in FIG. 5 and the like. Components of the electric shaver 1 according to the second embodiment that are the same as those in the electric shaver 1 according to the first embodiment are denoted with the same reference numerals, and the description thereof is partially or entirely omitted.

Figure 5:
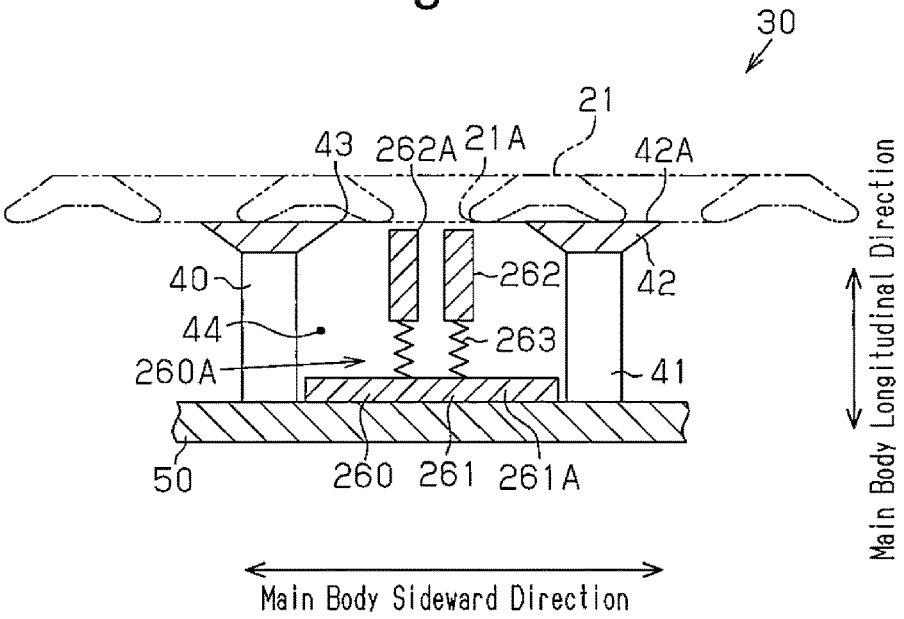
FIG. 5 is a cross-sectional view of an inner blade unit according to a second embodiment.

The configuration of the skin guard 260 according to the second embodiment will now be described with reference to FIG. 5.

The skin guard 260 has a skin entry restriction function. The skin guard 260 is located in the inner blade internal space 44 at a position corresponding to the inner blade hole 43. A plurality of the skin guards 260 are formed at positions corresponding to the inner blade holes 43 in the main body sideward direction. The skin guard 260 includes a guard base 261, a guard contact portion 262, and a guard elastic portion 263. The guard base 261 and the guard contact portion 262 of the skin guard 260 are formed from the same material.

The guard base 261 is coupled to the inner blade joint component 50. The guard base 261 is formed from a resin material. The guard base 261 has a rectangular parallelepiped shape. The guard base 261 supports the guard elastic portion 263.

The guard contact portion 262 is formed from a resin material. The guard contact portion 262 has a shape that extends from the guard base 261 toward the inner blade hole 43. The guard contact portion 262 comes into contact with the skin that enters the inner blade internal space 44 through the inner blade hole 43. The guard contact portion 262 is located toward the inner blade internal space side from the distal end surface 42A of the blade piece 42. The guard contact portion 262 includes a plurality of openings 62A arranged in the main body longitudinal direction and the main body depth direction. Facial hair enters the inner blade internal space 44 through the plurality of openings 62A. The plurality of openings 62A are formed on the inner blade hole side of the guard contact portion 62.

The guard elastic portion 263 is formed from an elastic material. The guard elastic portion 263 is located between the guard base 261 and the guard contact portion 262. The guard elastic portion 263 is supported by the guard base 261. The guard elastic portion 263 supports the guard contact portion 262. Suspension force of the guard elastic portion 263 is larger than suspension force of the inner blade 40 and the outer blade 21.

Figure 6:
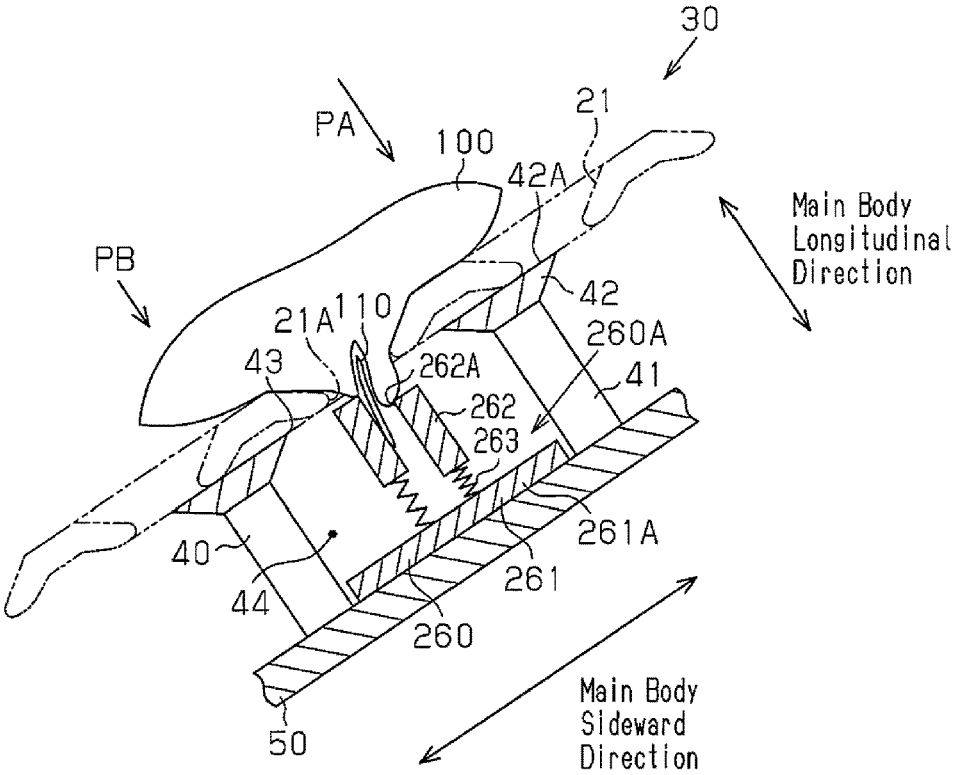
FIG. 6 is a diagram related to the inner blade unit according to the second embodiment, and is a cross-sectional view illustrating a state in which the skin and the facial hair have entered the inner blade internal space.

The operation of the electric shaver 1 according to the second embodiment will now be described with reference to FIG. 6.

The user presses the outer blade 21 against the skin 100. At this point, pressure may be unevenly applied to the outer blade 21 depending on how the user presses the outer blade 21. When local contact occurs, pressing force PA is applied to one outer blade 21 for example. On the other hand, pressing force PB is applied to the other outer blade 21. The pressing force PB is smaller than the pressing force PA.

The facial hair 110 enters the inner blade internal space 44 through the outer blade hole 21A and the inner blade hole 43. The skin 100 enters the inner blade hole 43 through the outer blade hole 21A. At this point, the skin 100 comes into contact with the guard contact portion 262 of the skin guard 260. A contraction amount of the guard elastic portion 263, corresponding to the outer blade 21 to which the pressing force PA is applied, is larger than a contraction amount of the guard elastic portion 263, corresponding to the outer blade 21 to which the pressing force PB is applied.

The electric shaver 1 according to the second embodiment has the following advantages in addition to the advantages (1) to (3).

(4) The guard elastic portion 263 elastically deforms in accordance with the pressing force from the outer blade 21 to the skin 100. Thus, the position of the guard contact portion 262 changes in accordance with the pressing force from the outer blade 21 to the skin 100. Accordingly, contact pressure between the guard contact portion 262 and the skin 100 can be prevented from being uneven, even when local contact occurs.

(5) The suspension force of the guard elastic portion 263 is larger than the suspension force of the inner blade 40 and the outer blade 21. This facilitates the contact between the guard contact portion 262 and the skin 100 drawn into the inner blade hole 43 through the outer blade hole 21A when the outer blade 21 is pressed against the skin 100.

Third Embodiment

An electric shaver 1 according to a third embodiment differs from the electric shaver 1 according to the first embodiment in the following point but is otherwise the same. The inner blade unit 30 according to the first embodiment includes the skin guard 60 illustrated in FIG. 3 and the like. An inner blade unit 30 according to the third embodiment includes a skin guard 360 illustrated in FIG. 7 and the like. The electric shaver 1 according to the third embodiment further includes a pressing force detector 370 and a control unit 380 illustrated in FIG. 7 and the like. Components of the electric shaver 1 according to the third embodiment that are the same as those in the electric shaver 1 according to the first embodiment are denoted with the same reference numerals, and the description thereof is partially or entirely omitted.

The configuration of the electric shaver 1 according to the third embodiment will now be described with reference to FIG. 7.

The electric shaver 1 includes the skin guard 360, the pressing force detector 370, and the control unit 380.

The skin guard 360 is formed from a resin material. The skin guard 360 has a skin entry restriction function. The skin guard 360 is located in the inner blade internal space 44 at a position corresponding to the inner blade hole 43. A plurality of the skin guards 360 are formed at positions corresponding to the inner blade holes 43 in the main body sideward direction. The skin guard 360 includes a guard base 361 and a guard contact portion 362. The guard base 361 and the guard contact portion 362 are integrally formed from the same material. The skin guard 360 is electrically connected to the control unit 380.

The guard base 361 is coupled to the inner blade joint component 50. The guard base 361 has a rectangular parallelepiped shape. The guard base 361 supports the guard contact portion 362.

The guard contact portion 362 has a shape that extends from the guard base 361 toward the inner blade hole 43. The guard contact portion 362 has a configuration in which a distal end can be deformed in the main body longitudinal direction. The guard contact portion 362 comes into contact with the skin that enters the inner blade internal space 44 through the inner blade hole 43. The guard contact portion 362 is located toward the inner blade internal space from the distal end surface 42A of the blade piece 42. The guard contact portion 362 includes a plurality of openings 362A arranged in the main body longitudinal direction and the main body depth direction. Facial hair enters the inner blade internal space 44 through the plurality of openings 362A. The plurality of openings 362A are formed in a portion on the inner blade hole side of the guard contact portion 362.

A pressure sensor is used as the pressing force detector 370. The pressing force detector 370 detects pressing force PX, and supplies a pressure detection signal corresponding to the detected pressing force PX to the control unit 380. The pressing force PX indicates pressure applied to the outer blade 21 when the outer blade 21 is pressed against the skin. The pressing force detector 370 is attached to the inner blade joint component 50. The pressing force detector 370 is electrically connected to the control unit 380.

The control unit 380 performs control so that a position of a distal end of the guard contact portion 362 is moved toward the inner blade hole 43 in accordance with the pressure detection signal indicating an increase in the pressing force PX. The control unit 380 is accommodated in the shaver main body 10.

The operation of the electric shaver 1 according to the third embodiment will now be described with reference to FIG. 8.

The user presses the outer blade 21 against the skin 100. When the pressing force PX, applied to the outer blade 21, increases from initial pressing force PXA to pressing force PXB due to local contact for example, the control unit 380 moves the position of the distal end of the guard contact portion 362 toward the inner blade hole 43. More specifically, skin pushback force of the skin guard 360 is increased. The skin pushback force is force of the skin guard 360 to push back the skin that enters the inner blade internal space 44 through the outer blade hole 21A and the inner blade hole 43.

The electric shaver 1 according to the third embodiment has the following advantage in addition to advantages (1) to (3).

(6) When the pressing force PX increases, the control unit 380 can change the skin pushback force in accordance with the change in the pressing force PX so that the position of the distal end of the guard contact portion 362 moves toward the inner blade hole 43.

Figure 7:
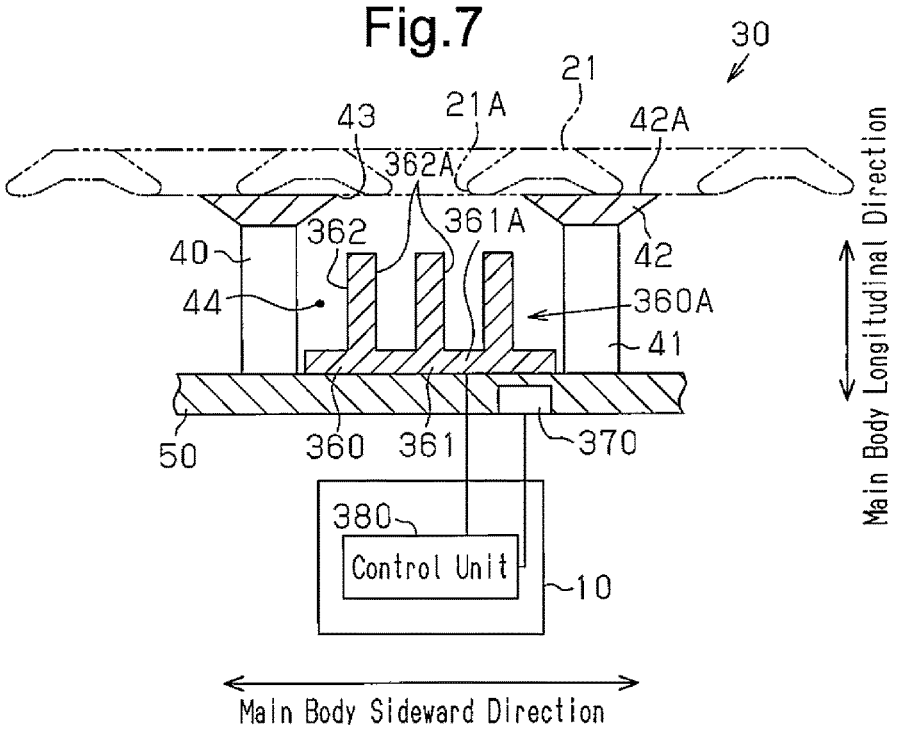
FIG. 7 is a cross-sectional view of an inner blade unit and a control unit according to a third embodiment.
Figure 8:
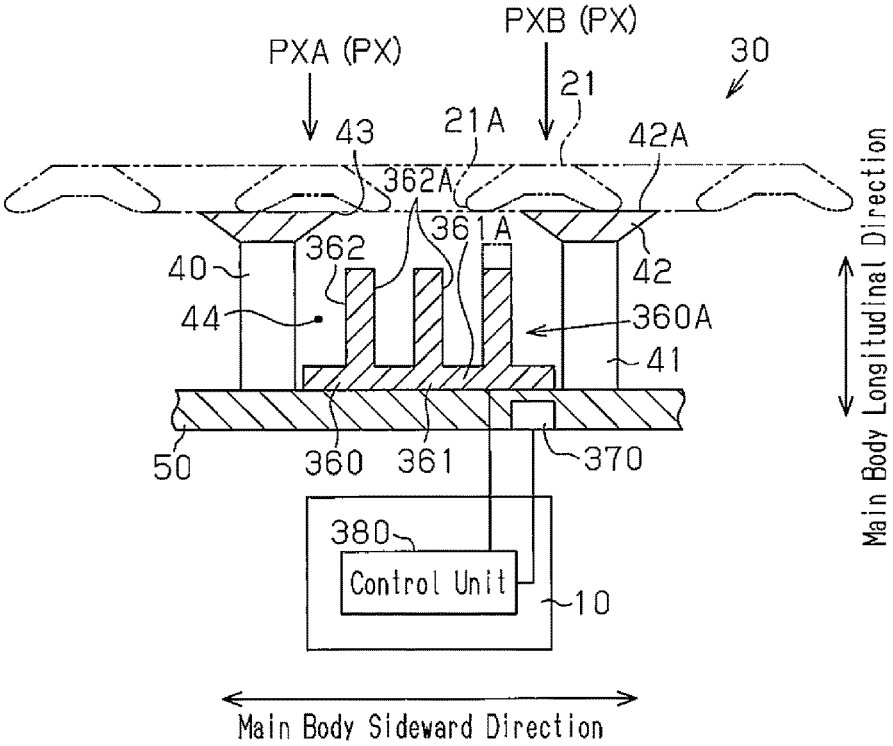
FIG. 8 is a cross-sectional view of the inner blade unit and the control unit according to the third embodiment.

In the example illustrated in FIG. 7 and FIG. 8, the skin guard 360 includes the guard base 361 and the plurality of guard contact portions 362. A single guard contact portion 362 and a guard base 361A serving as a part of the guard base 361 supporting the guard contact portion 362 form a skin guard 360A as a basic element of the skin guard 360. For example, three skin guards 360A are arranged in the main body sideward direction. The guard bases 361A of the adjacent skin guards 360 are coupled with each other to form the guard base 361. The guard bases 361A of the plurality of skin guards 360A are coupled with each other. This forms a single skin guard 360 that is larger than each skin guard 360A.

Fourth Embodiment

An electric shaver 1 according to a fourth embodiment differs from the electric shaver 1 according to the third embodiment in the following point but is otherwise the same. The electric shaver 1 according to the third embodiment includes the pressing force detector 370 illustrated in FIG. 7 and the like. The electric shaver 1 according to the fourth embodiment includes a skin-entry amount detector 470 illustrated in FIG. 9 and the like. Components of the electric shaver 1 according to the fourth embodiment that are the same as those in the electric shaver 1 according to the third embodiment are denoted with the same reference numerals, and the description thereof is partially or entirely omitted.

Figure 9:
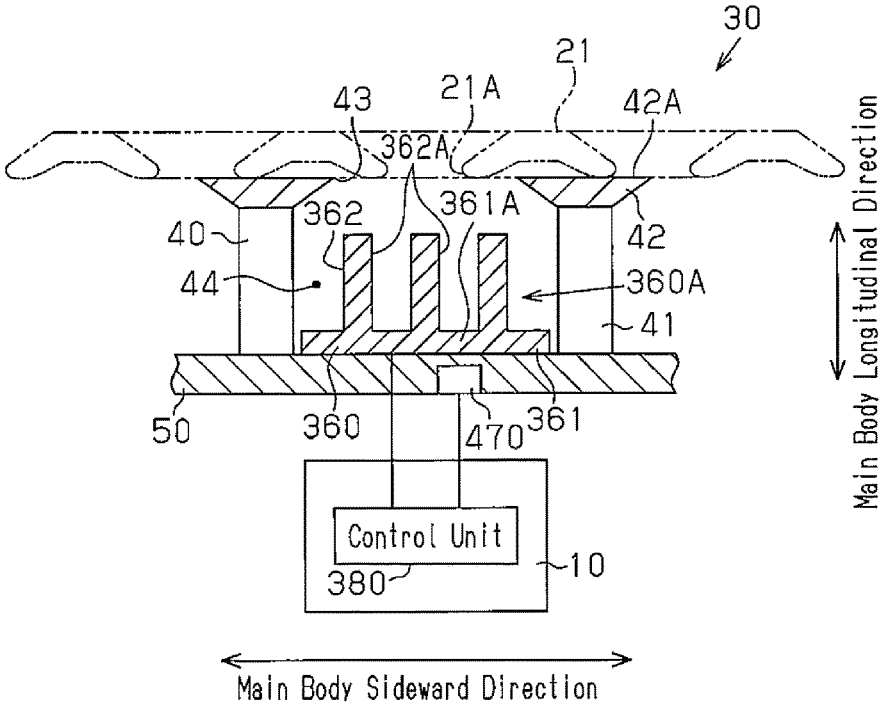
FIG. 9 is a cross-sectional view of an inner blade unit and a control unit according to a fourth embodiment.

The configuration of the electric shaver 1 according to the fourth embodiment will now be described with reference to FIG. 9.

The electric shaver 1 includes the skin-entry amount detector 470 and the control unit 380.

The skin-entry amount detector 470 detects a skin-entry amount and supplies a skin-entry amount detection signal, corresponding to the detected skin-entry amount, to the control unit 380. The skin-entry amount indicates an amount of the skin that enters the inner blade internal space 44 through the outer blade hole 21A and the inner blade hole 43. A reflective photoelectric sensor is used as the skin-entry amount detector 470. The skin-entry amount detector 470 is attached to the inner blade joint component 50. The skin-entry amount detector 470 is electrically connected to the control unit 380.

The control unit 380 performs control so that the position of the distal end of the guard contact portion 362 is moved toward the inner blade hole 43 in accordance with the skin-entry amount detection signal indicating an increase in the skin-entry amount. The control unit 380 is accommodated in the shaver main body 10.

Figure 10:
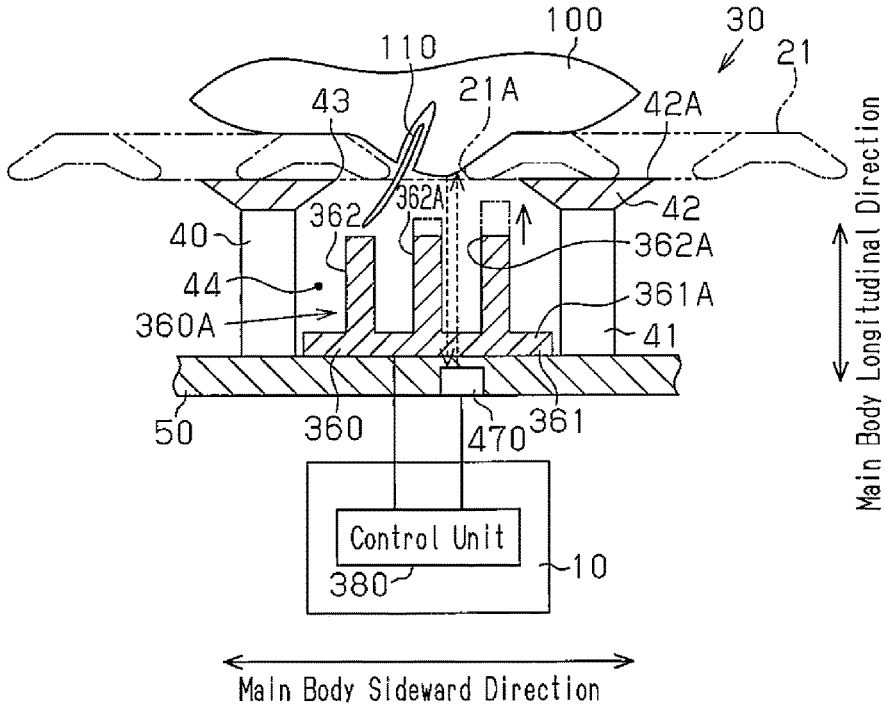
FIG. 10 is a diagram related to the inner blade unit and the control unit according to the fourth embodiment, and illustrates a state in which an outer blade is pressed against the skin.

The operation of the electric shaver 1 will now be described with reference to FIG. 10.

The user presses the outer blade 21 against the skin 100. At this point, pressing force may be unevenly applied to the outer blade 21 when local contact occurs. Thus, the amount of skin entering the inner blade internal space 44 through the outer blade hole 21A and the inner blade hole 43 changes in accordance with the positions of the outer blade 21 and the inner blade 40. The skin-entry amount detector 470 irradiates the skin with a predetermined amount of light. The light, radiated from the skin-entry amount detector 470, reaches the skin 100 to be reflected. The reflected light returns to the skin-entry amount detector 470. The skin-entry amount detector 470 detects time T between the radiation of the light onto the skin and the returning of the reflected light to the skin-entry amount detector 470. The control unit 380 determines that the skin-entry amount has increased when the time T is shorter than a predetermined threshold TX. Upon determining that the skin-entry amount has increased, the control unit 380 moves the position of the distal end of the guard contact portion 362 toward the inner blade hole 43. More specifically, the skin pushback force of the skin guard 360 is increased.

The electric shaver 1 according to the fourth embodiment has advantages corresponding to advantages (1) to (3) and (6).

Fifth Embodiment

An electric shaver 1 according to a fifth embodiment differs from the electric shaver 1 according to the second embodiment in the following point but is otherwise the same. The electric shaver 1 according to the second embodiment includes the skin guard 260 illustrated in FIG. 5 and the like. The electric shaver 1 according to the fifth embodiment includes an oscillator 500 in addition to the skin guard 260 illustrated in FIG. 11 and the like. Components of the electric shaver 1 according to the fifth embodiment that are the same as those in the electric shaver 1 according to the second embodiment are denoted with the same reference numerals, and the description thereof is partially or entirely omitted.

Figure 11:
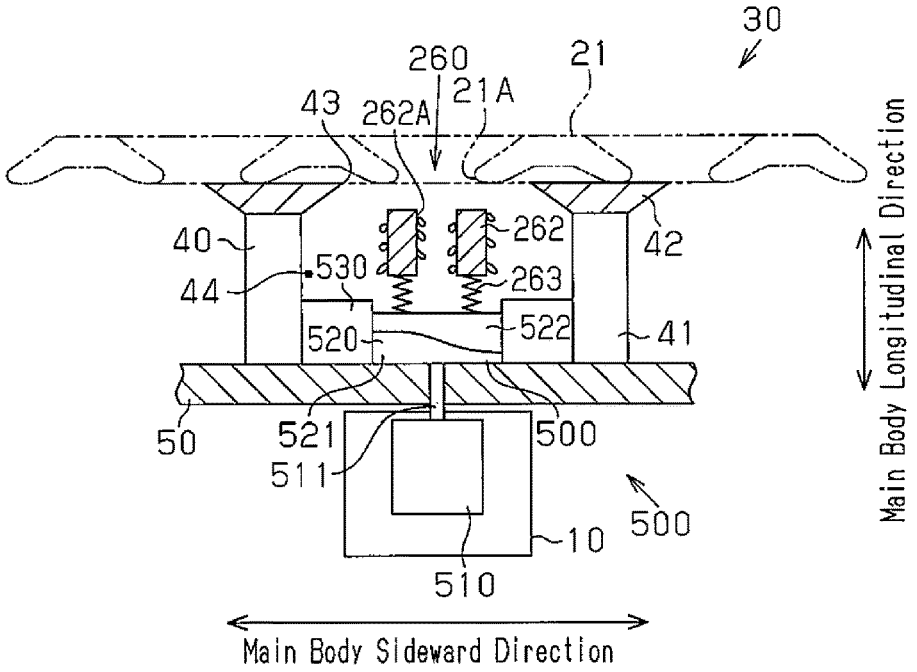
FIG. 11 is a cross-sectional view of an inner blade unit and an oscillator according to a fifth embodiment.

The configuration of the electric shaver 1 according to the fifth embodiment will now be described with reference to FIG. 11.

The electric shaver 1 includes the oscillator 500. The oscillator 500 oscillates the skin guard 260. The oscillator 500 includes an electric motor 510, a cam member 520, and a guide 530.

The electric motor 510 is accommodated in the shaver main body 10. The electric motor 510 includes an output shaft 511. The electric motor 510 rotates the output shaft 511. The output shaft 511 is coupled to a first cam member 521 of the cam member 520. The cam member 520 includes the first cam member 521 and a second cam member 522.

The first cam member 521 is attached to the inner blade joint component 50. The second cam member 522 is attached to top of the first cam member 521. The second cam member 522 supports the guard elastic portion 263. The second cam member 522 moves back and forth in the main body longitudinal direction when the first cam member 521 rotates.

The guide 530 guides the rotation of the first cam member 521. The guide 530 guides the back and forth movement of the second cam member 522 in the main body longitudinal direction. The guide 530 is attached to the inner blade joint component 50.

Figure 12:
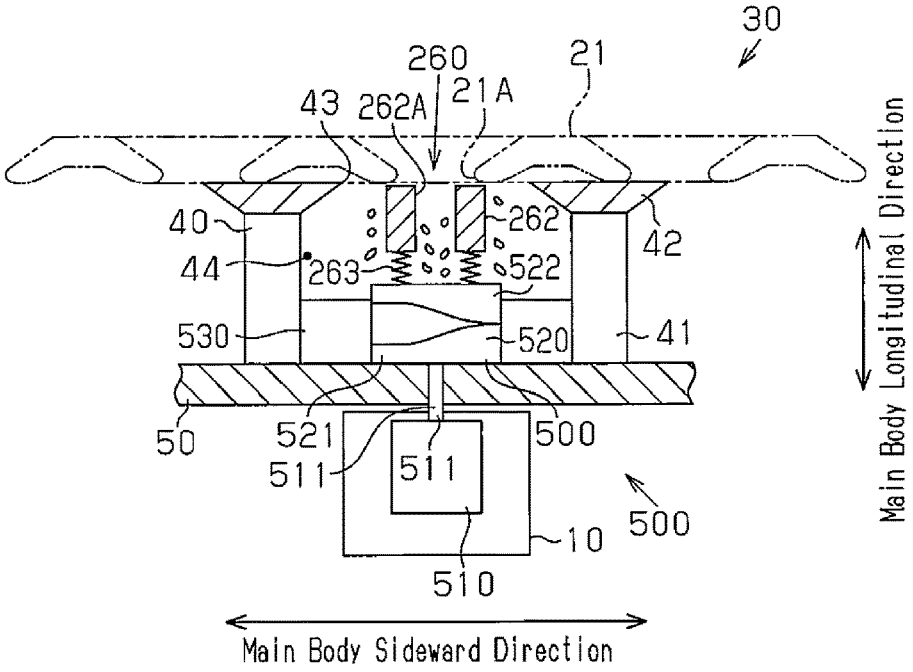
FIG. 12 is a diagram related to the inner blade unit and the oscillator according to the fifth embodiment, and is a cross-sectional view illustrating a state in which a skin guard is oscillating.

The operation of the electric shaver 1 will now be described with reference to FIG. 12.

The electric motor 510 rotates the output shaft 511. When the output shaft 511 rotates, the first cam member 521 rotates. When the first cam member 521 rotates, the second cam member 522 moves back and forth in the main body longitudinal direction. Thus, the skin guard 260 oscillates and shakes off the shaved facial hair attached to the skin guard 260.

The electric shaver 1 according to the fifth embodiment has the following advantages, in addition to advantages (1) to (3) and (4).

(7) The oscillator 500 oscillates the skin guard 260 and shakes off the shaved facial hair attached to the skin guard 260. Thus, the facial hair is not interfered with when entering the inner blade internal space 44.

Sixth Embodiment

An electric shaver 1 according to a sixth embodiment differs from the electric shaver 1 according to the first embodiment in the following point but is otherwise the same. The electric shaver 1 according to the first embodiment includes the skin guard 60 illustrated in FIG. 3 and the like. The electric shaver 1 according to the sixth embodiment includes a skin guard 660 illustrated in FIG. 13 and the like. Components of the electric shaver 1 according to the sixth embodiment that are the same as those in the electric shaver 1 according to the first embodiment are denoted with the same reference numerals, and the description thereof is partially or entirely omitted.

Figure 13:
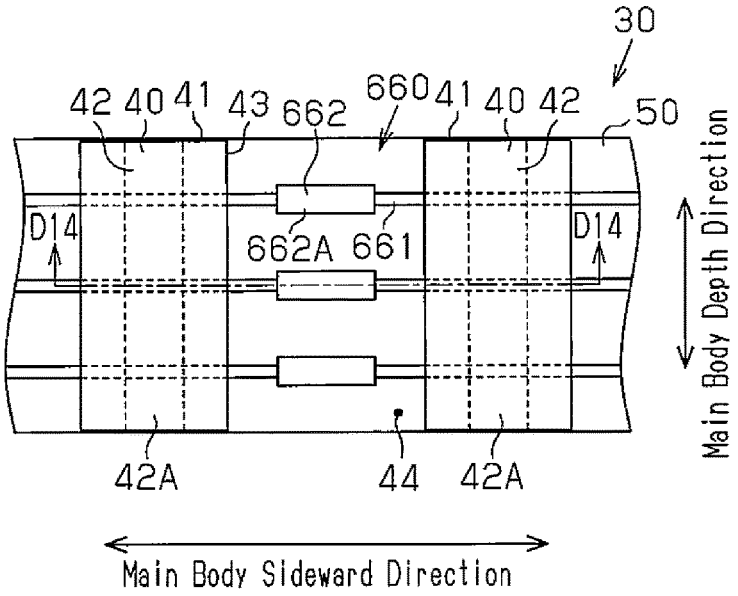
FIG. 13 is a plan view of an inner blade unit according to a sixth embodiment.

The configuration of the skin guard 660 according to the sixth embodiment will now be described with reference to FIG. 13.

The skin guard 660 has a skin entry restriction function. The skin guard 260 is located in the inner blade internal space 44 at a position corresponding to the inner blade hole 43. The skin guard 660 includes a rotational shaft 661 and a rotating portion 662.

The rotational shaft 661 is formed from a metal material. The rotational shaft 661 has a shape that extends in the main body sideward direction in the inner blade internal space 44. The rotational shaft 661 rotationally supports the rotating portion 662. An end portion (not illustrated) of the rotational shaft 661 is secured to an end portion (not illustrated) of the inner blade joint component 50. The rotational shaft 661 can be detached from the inner blade joint component 50.

The rotating portion 662 is formed from a resin material. The rotating portion 662 rotates when contacting the skin that enters the inner blade internal space 44 through the inner blade hole 43. A plurality of the rotating portions 662 are formed at positions corresponding to the inner blade holes 43 in the main body sideward direction. The rotating portion 662 can be detached from the inner blade joint component 50, together with the rotational shaft 661. The rotating portion 662 includes a skin contact surface 662A. The skin contact surface 662A is located toward the inner blade internal space side from the distal end surface 42A of the blade piece 42.

Figure 14:
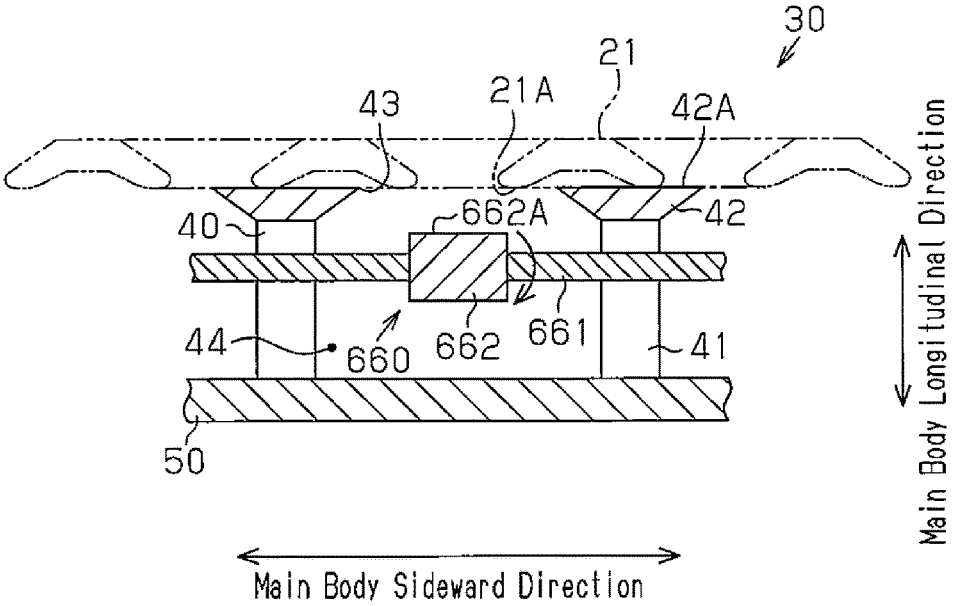
FIG. 14 is a cross-sectional view taken along a line D14-D14 in FIG. 13.

The operation of the electric shaver 1 will now be described with reference to FIG. 14.

The user presses the outer blade 21 against the skin 100. The skin 100 enters the inner blade internal space 44 through the outer blade hole 21A and the inner blade hole 43 and comes into contact with the rotating portion 662. The user changes the positions of the outer blade 21 and the inner blade 40 with respect to the skin 100, while pressing the outer blade 21 against the skin 100. The rotating portion 662 rotates while contacting the skin 100 in accordance with the movement of the outer blade 21 and the inner blade 40 relative to the skin 100.

The electric shaver 1 according to the sixth embodiment has the following advantage in addition to advantages (1) to (3).

(8) The rotating portion 662 rotates while contacting the skin 100. This reduces friction between the skin guard 660 and the skin 100.

Seventh Embodiment

An electric shaver 1 according to a seventh embodiment differs from the electric shaver 1 according to the first embodiment in the following point but is otherwise the same. The electric shaver 1 according to the first embodiment includes the skin guard 60 illustrated in FIG. 3 and the like. The electric shaver 1 according to the seventh embodiment includes a skin guard 760 illustrated in FIG. 15 and the like. Components of the electric shaver 1 according to the seventh embodiment that are the same as those in the electric shaver 1 according to the first embodiment are denoted with the same reference numerals, and the description thereof is partially or entirely omitted.

The configuration of the skin guard 760 according to the seventh embodiment will now be described with reference to FIG. 15 and FIG. 16.

Figure 15:
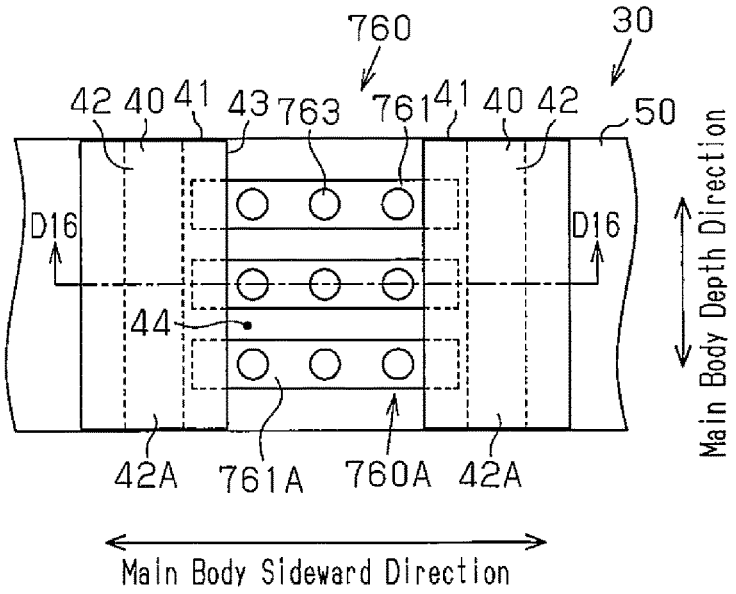
FIG. 15 is a plan view of an inner blade unit according to a seventh embodiment.
Figure 16:
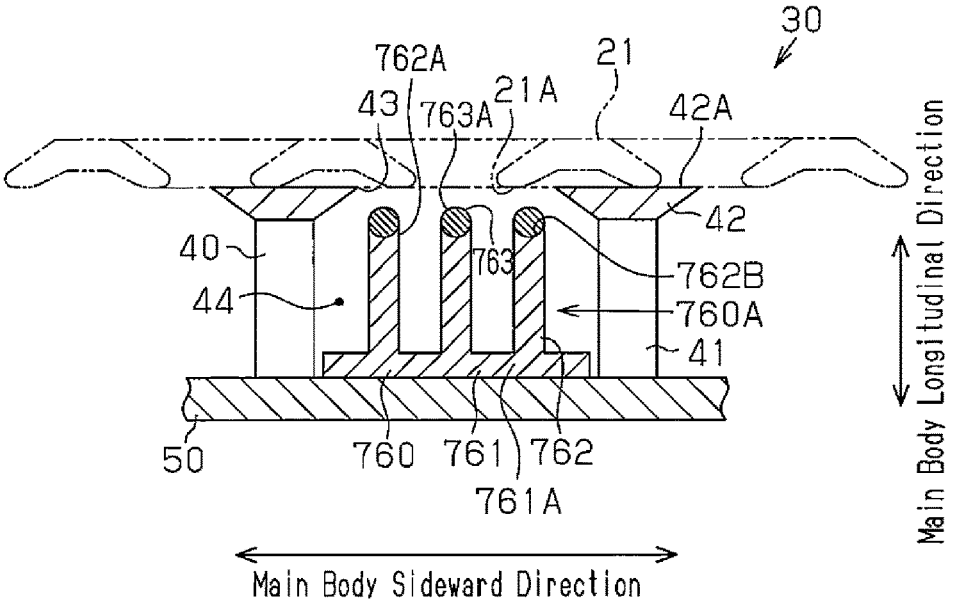
FIG. 16 is a cross-sectional view taken along a line D16-D16 in FIG. 15.

As illustrated in FIG. 15 and FIG. 16, the skin guard 760 has a skin entry restriction function. The skin guard 760 is located in the inner blade internal space 44 at a position corresponding to the inner blade hole 43. A plurality of the skin guards 760 are formed at positions corresponding to the inner blade holes 43 in the main body sideward direction. The skin guard 760 includes a guard base 761, a guard contact portion 762, and a rotating portion 763. The guard base 761 and the guard contact portion 762 are integrally formed from the same material.

The guard base 761 is coupled to the inner blade joint component 50. The guard base 761 has a rectangular parallelepiped shape. The guard base 761 supports the guard contact portion 762.

The guard contact portion 762 has a shape that extends toward the inner blade hole 43. The guard contact portion 762 has a skin entry restriction function. The guard contact portion 762 is located toward the inner blade internal space side from the distal end surface 42A of the blade piece 42.

The guard contact portion 762 includes an opening 762A and a distal end recess 762B. Facial hair enters the inner blade internal space 44 through the opening 762A. The opening 762A is formed in a portion on a side of the inner blade hole of the guard contact portion 762. The distal end recess 762B rotationally supports the rotating portion 763. The distal end recess 762B is formed at a distal end of the guard contact portion 762.

The rotating portion 763 is formed from a resin material. The rotating portion 763 rotates when contacting the skin that enters the inner blade internal space 44 through the inner blade hole 43. The rotating portion 763 has a spherical shape. A rotating spherical surface 763A of the rotating portion 763 is located toward the inner blade internal space side from the distal end surface 42A of the blade piece 42.

The operation of the electric shaver 1 will now be described with reference to FIG. 16.

The user presses the outer blade 21 against the skin 100. The skin 100 enters the inner blade internal space 44 through the outer blade hole 21A and the inner blade hole 43 and comes into contact with the rotating portion 763. The user changes the positions of the outer blade 21 and the inner blade 40 with respect to the skin 100, while pressing the outer blade 21 against the skin 100. The rotating portion 763 rotates while contacting the skin 100 in accordance with the movement of the outer blade 21 and the inner blade 40 relative to the skin 100.

The electric shaver 1 according to the sixth embodiment has advantages (1) to (3) and (8).

In the example illustrated in FIG. 15 and FIG. 16, the skin guard 760 includes the guard base 761 and the plurality of guard contact portions 762. A single guard contact portion 762 and a guard base 761A serving as a part of the guard base 761 supporting the guard contact portion 762 form a skin guard 760A as a basic element of the skin guard 760. For example, three skin guards 760A are arranged in the main body sideward direction. The guard bases 761A of the adjacent skin guards 760 are coupled with each other to form the guard base 761. The guard bases 761A of the plurality of skin guard 760A are coupled with each other. This forms a single skin guard 760 that is larger than each skin guard 760A. Each of the skin guards 760A are arranged in correspondence with a different inner blade hole 43.

Eighth Embodiment

Figure 17:
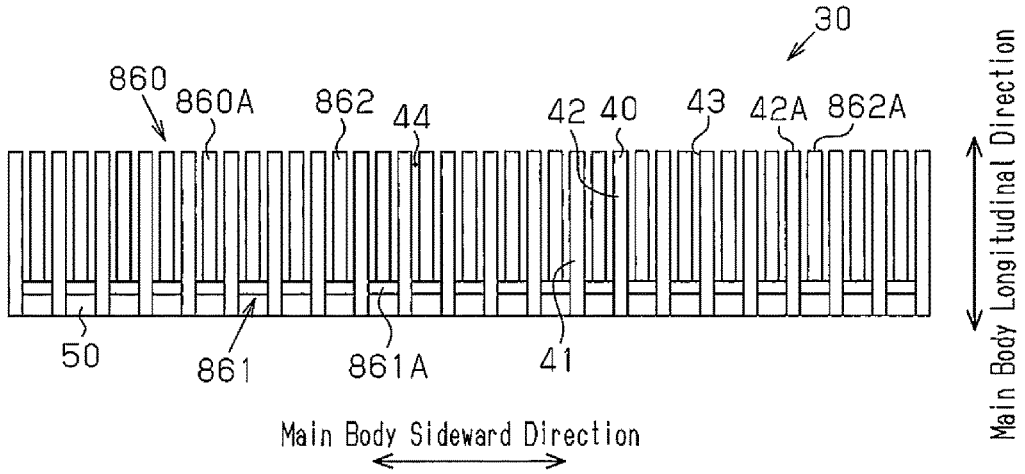
FIG. 17 is a front view of an inner blade unit according to an eighth embodiment.

An electric shaver 1 according to an eighth embodiment includes a skin guard 860 illustrated in FIG. 17 instead of the skin guard 60 according to the first embodiment. Components of the electric shaver 1 according to the eighth embodiment that are the same as those in the electric shaver 1 according to the first embodiment are denoted with the same reference numerals, and the description thereof is partially or entirely omitted.

The configuration of the skin guard 860 according to the eighth embodiment will now be described with reference to FIG. 17.

The skin guard 860 has a skin entry restriction function. The skin guard 860 includes a guard base 861 and a plurality of guard contact portions 862. A single guard contact portion 862 and a guard base 861A serving as a part of the guard base 861 supporting the guard contact portion 862 form a skin guard 860A as a basic element of the skin guard 860. The skin guards 860A are arranged in the main body sideward direction. The guard bases 861A of the adjacent skin guards 860 are coupled with each other to form the guard base 861. The guard bases 861A of the plurality of skin guard 860A are coupled with each other. This forms a single skin guard 860 that is larger than each skin guard 860A. The plurality of skin guards 860A are each located to correspond to the corresponding one of the inner blade holes 43 different from each other. The plurality of skin guards 860A respectively correspond to all the inner blade holes 43. The position of a distal end surface 862A of the guard contact portion 862 in the main body longitudinal direction substantially matches the distal end surface 42A of the blade piece 42. The electric shaver 1 according to the eighth embodiment has advantages (1) to (3).

Ninth Embodiment

Figure 18:
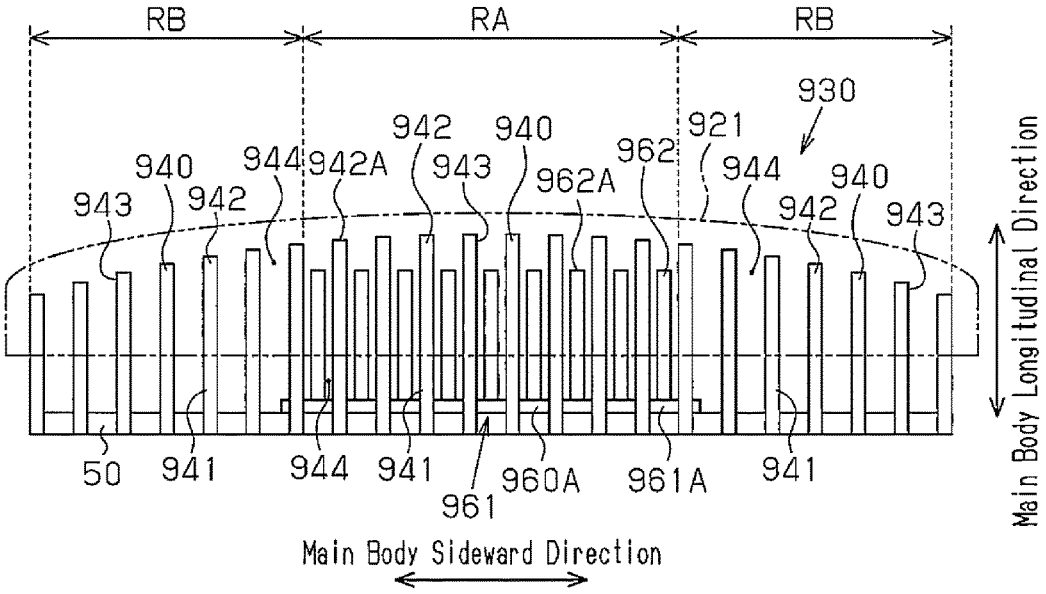
FIG. 18 is a front view of an inner blade unit and an outer blade according to a ninth embodiment.

An electric shaver 1 according to a ninth embodiment includes an inner blade unit 930 illustrated in FIG. 18 instead of the inner blade unit 30 according to the eighth embodiment. Components of the electric shaver 1 according to the ninth embodiment that are the same as those in the electric shaver 1 according to the eighth embodiment are denoted with the same reference numerals, and the description thereof is partially or entirely omitted.

A configuration of the inner blade unit 930 will now be described with reference to FIG. 18.

The inner blade unit 930 includes a plurality of inner blades 940. The plurality of inner blades 940 are arranged in the main body sideward direction. The inner blades 940 include inner blade main body walls 941, blade pieces 942, and inner blade holes 943.

The inner blade main body wall 941 and the blade piece 942 are integrally formed from the same material. The inner blade main body wall 941 and the blade pieces 942 form an inner blade internal space 944. The inner blade hole 943 is formed between the adjacent blade pieces 942.

The plurality of inner blades 940 have the inner blade main body walls 941 with heights in the main body longitudinal direction different from each other. The most outer inner blades 940 in the main body sideward direction are the shortest. The center one and the ones around the center one of the plurality of inner blades 940 (hereinafter, referred to as "center inner blade") are the highest. The inner blade main body wall 941 farther from the outermost inner blade 940 and thus is closer to the center inner blade is higher. The inner blades 940 have different heights as described above. Thus, distal end portions of the inner blades 940 form an arch shape in a front view of the inner blades 940. An outer blade 921 illustrated with a double-dashed line has the shape of an arch corresponding to the shape of the inner blades 940.

The inner blade unit 930 can be divided into three sections, including a longitudinal high pressure portion RA and two longitudinal low pressure portions RB, in the main body sideward direction. The sections are defined based on the pressure applied to the inner blade 940, while the electric shaver 1 is being used. The longitudinal high pressure portion RA is an intermediate section in the arch shape, and is likely to receive higher pressure than the longitudinal low pressure portion RB. The longitudinal low pressure portions RB at two positions are sections on both sides of the longitudinal high pressure portion RA in the main body sideward direction, and are likely to receive lower pressure than the longitudinal high pressure portion RA. The pressure relationship is established mainly because the inner blade 940 corresponding to the longitudinal high pressure portion RA has a shape that easily fits the skin.

The skin guard 960 includes a guard base 961 and a plurality of guard contact portions 962. A single guard contact portion 962 and a guard base 961A serving as a part of the guard base 961 supporting the guard contact portion 962 form a skin guard 960A as a basic element of the skin guard 960. The skin guards 960A are arranged in the main body sideward direction. The guard bases 961A of the adjacent skin guards 960A are coupled with each other to form the guard base 961. The guard bases 961A of the plurality of skin guard 960A are coupled with each other. This forms a single skin guard 960 that is larger than each skin guard 960A. Each of the plurality of skin guards 960A are arranged in correspondence with a different inner blade holes 943.

The skin guard 960 is located in the inner blade internal space 944 corresponding to the longitudinal high pressure portion RA of the inner blade unit 930. The plurality of skin guards 960A respectively correspond to all of the inner blade holes 943 in the longitudinal high pressure portion RA. A position of the distal end surface 962A of the guard contact portion 962 in the main body longitudinal direction is located toward the inner blade internal space side from a distal end surface 942A of the blade piece 942 in the longitudinal high pressure portion RA.

The electric shaver 1 according to the ninth embodiment provides the following advantage in addition to advantages (1) to (3).

(9) Generally, it is difficult to shave the facial hair growing in a portion where the skin is recessed. A portion under the chin is one example of the portion where the skin is recessed. In the electric shaver 1, the outer blade 921 has the arch shape. Thus, the outer blade 921 easily fits the portion where the skin is recessed, and thus the unshaved facial hair is less likely to remain. On the other hand, the skin is likely to enter the inner blade internal space 944 through the inner blade hole 943 in the longitudinal high pressure portion RA since the outer blade 921 and the inner blade 940 have the arch shape. Thus, the skin may be strongly irritated when the electric shaver does not include the skin guard 960. The arch shapes of the outer blade 921 and the inner blade 940 facilitates shaving of the facial hair but also increases the risk of strongly irritating the skin.

In the electric shaver 1 according to the ninth embodiment, the skin guard 960 is located in the inner blade internal space 944 corresponding to the longitudinal high pressure portion RA. Thus, the skin is less likely to enter the inner blade internal space 944 corresponding to the longitudinal high pressure portion RA. Thus, the configuration of the outer blade 921 and the inner blade 940 improving the shaving performance of the facial hair is achieved, with a low risk of strongly irritating the skin. Accordingly, the advantage of improving shaving performance of the facial hair and the advantage of protecting the skin can be achieved.

Tenth Embodiment

Figure 19:
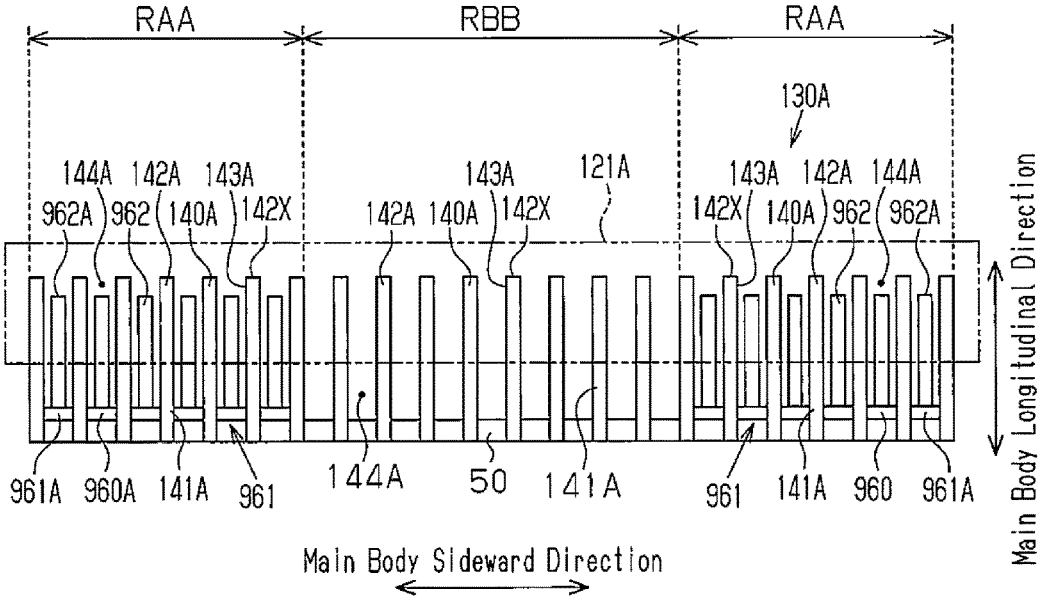
FIG. 19 is a front view of an inner blade unit and an outer blade according to a tenth embodiment.

An electric shaver 1 according to a tenth embodiment includes an inner blade unit 130A illustrated in FIG. 19 instead of the inner blade unit 930 according to the ninth embodiment. Components of the electric shaver 1 according to the tenth embodiment that are the same as those in the electric shaver 1 according to the ninth embodiment are denoted with the same reference numerals, and the description thereof is partially or entirely omitted.

The configuration of the inner blade unit 130A will now be described with reference to FIG. 19.

The inner blade unit 130A includes a plurality of inner blades 140A and the skin guard 960. The plurality of inner blades 140A are arranged in the main body sideward direction. The inner blades 140A include inner blade main body walls 141A, blade pieces 142A, and inner blade holes 143A.

The inner blade main body wall 141A and the blade piece 142A are integrally formed from the same material. The inner blade main body wall 141A and the blade pieces 142A form an inner blade internal space 144A. The inner blade hole 143A is formed between the adjacent blade pieces 142A.

The inner blades 140A of the inner blade unit 130A have substantially the same height in the main body longitudinal direction. With this height relationship among the inner blades 140A, distal end portions of the inner blades 140A form a flat shape in the front view of the inner blades 140A. An outer blade 121A illustrated with a double-dashed line has a flat shape corresponding to the shape of the inner blades 140A.

The inner blade unit 130A can be divided in the main body sideward direction into three portions that include a longitudinal high pressure portion RAA and two longitudinal low pressure portions RBB. The sections are defined based on the pressure applied to the inner blade 140A, while the electric shaver 1 is being used. In the electric shaver 1, due to the shape of the inner blades 140A, an end portion of the outer blade 121A is frequently used by being pressed against the portion where the skin is recessed. Thus, the two longitudinal high pressure portions RAA are likely to receive higher pressure than the longitudinal low pressure portion RBB. The longitudinal low pressure portion RBB is located between the two longitudinal high pressure portions RAA and is likely to receive lower pressure than the longitudinal high pressure portions RAA.

The skin guard 960 is located in the inner blade internal space 144A corresponding to the longitudinal high pressure portions RAA of the inner blade unit 130A. The plurality of skin guards 960A respectively correspond to all of the inner blade holes 143A in the longitudinal high pressure portion RAA. The position of the distal end surface 962A of the guard contact portion 962 in the main body longitudinal direction is slightly lower than the position of a distal end surface 142X of the blade piece 142A in the longitudinal high pressure portion RAA.

The electric shaver 1 according to the tenth embodiment has the following advantage in addition to advantages (1) to (3).

(10) In the electric shaver 1, the skin guards 960 are located in the inner blade internal spaces 144A corresponding to the inner blade holes 143A in the longitudinal high pressure portions RAA. Thus, the skin is less likely to enter the inner blade internal space 144A corresponding to the longitudinal high pressure portion RAA. Accordingly, the skin is less likely to be strongly irritated.

Eleventh Embodiment

Figure 20:
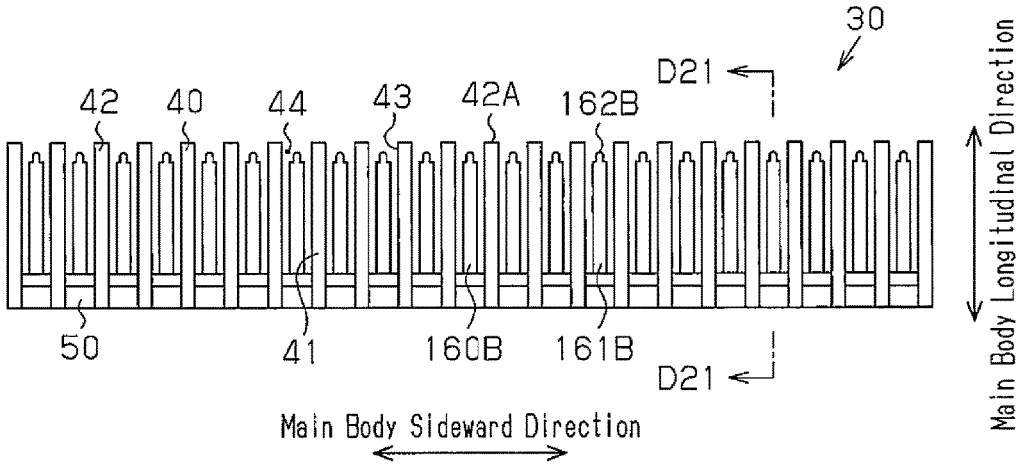
FIG. 20 is a front view of an inner blade unit according to an eleventh embodiment.

An electric shaver 1 according to an eleventh embodiment includes a skin guard 160B illustrated in FIG. 20 and the like instead of the skin guard 860 according to the eighth embodiment. Components of the electric shaver 1 according to the eleventh embodiment that are the same as those in the electric shaver 1 according to the eighth embodiment are denoted with the same reference numerals, and the description thereof is partially or entirely omitted.

The configuration of the skin guard 160B will now be described with reference to FIG. 20 to FIG. 22.

As illustrated in FIG. 20, the electric shaver 1 includes a plurality of skin guards 160B. The plurality of skin guards 160B are arranged in the main body sideward direction. The plurality of skin guards 160B are each located in the inner blade internal space 44 corresponding to the corresponding one of the inner blade holes 43 different from each other. The plurality of skin guards 160B respectively correspond to all of the inner blade holes 43.

Figure 21:
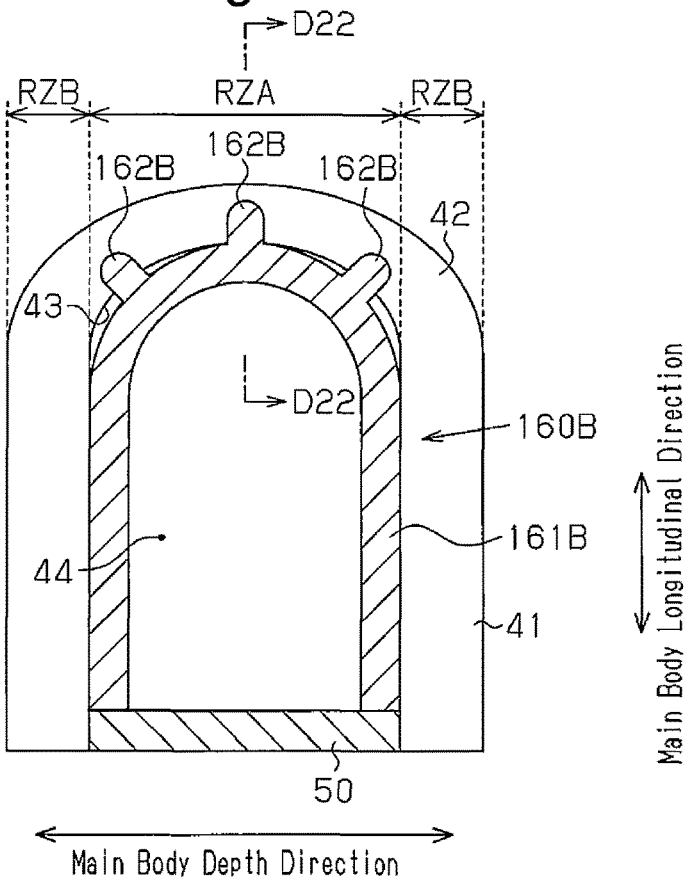
FIG. 21 is a cross-sectional view taken along a line D21-D21 in FIG. 20.
Figure 22:
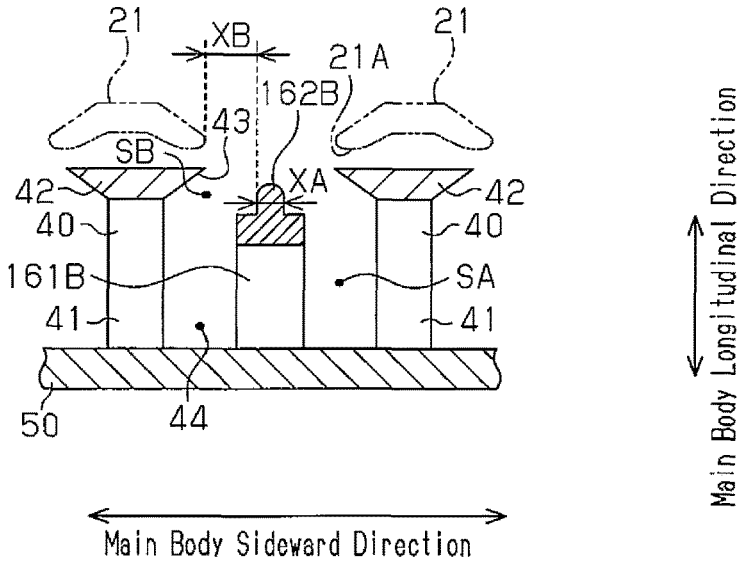
FIG. 22 is a cross-sectional view taken along a line D22-D22 in FIG. 21.

As illustrated in FIG. 21, the skin guard 160B includes a first skin guard 161B and a plurality of second skin guards 162B. The first skin guard 161B may have an arch shape. For example, three second skin guards 162B are arranged in a lateral direction of the inner blade joint component 50, that is, in the main body depth direction. The second skin guard 162B and the first skin guard 161B are integrally formed from the same material. The second skin guard 162B protrudes in a direction opposite to the inner blade joint component 50 from a curved portion of the first skin guard 161B. The second skin guard 162B has a protruding shape. A distal end of the second skin guard 162B has a semi-spherical shape.

The blade piece 42 can be divided in the main body depth direction into three portions, namely, a lateral high pressure portion RZA and two lateral low pressure portions RZB. The sections are defined based on the pressure applied to the inner blade 40, while the electric shaver 1 is being used. The lateral high pressure portion RZA is an intermediate section of the blade piece 42, and is likely to receive higher pressure than the lateral low pressure portion RZB. The lateral low pressure portions RZB at two positions are sections on both sides of the lateral high pressure portion RZA in the main body sideward direction, and are likely to receive lower pressure than the lateral high pressure portion RZA. The pressure relationship is established mainly because the lateral high pressure portion RZA has a shape that easily fits the skin.

As illustrated in FIG. 21, the first skin guard 161B is disposed in the lateral high pressure portion RZA between one of the lateral low pressure portions RZB and the other lateral low pressure portion RZB, in the main body depth direction. The plurality of second skin guards 162B are located at portions corresponding to the lateral high pressure portion RZA in the main body sideward direction. When an outer blade (not illustrated) is pressed against the skin, the skin is more likely to enter the inner blade hole 43 corresponding to the lateral high pressure portion RZA than the inner blade hole 43 corresponding to the lateral low pressure portion RZB. In the electric shaver 1, the skin guard 160B is configured based on such a behavior of the skin. The second skin guard 162B is located closer to an opening portion of the inner blade hole 43 than the first skin guard 161B. This effectively prevents the skin from entering the inner blade internal space 44. Thus, the second skin guard 162B is located in the portion corresponding to the lateral high pressure portion RZA, and the skin is much less likely to enter the inner blade internal space 44 compared with when the second skin guard 162B is not provided.

Sizes of the first skin guard 161B and the second skin guard 162B are described with reference to FIG. 22.

A width of the second skin guard 162B is shorter than a width of the first skin guard 161B. The width of the first skin guard 161B is a distance from one end surface to the other end surface of the first skin guard 161B. The width of the second skin guard 162B is a distance from one end surface to the other end surface of the second skin guard 162B.

The effect of the skin entry restriction function of each of the skin guards 161B, 162B mainly depends on a width XA of the distal end surface of the second skin guard 162B. The skin entry restriction function becomes more effective as the width XA increases. When the width XA is within a predetermined width range, a preferable skin entry restriction function is ensured. Thus, the width XA of the distal end surface of the second skin guard 162B is set to be within the predetermined width range.

Facial hair entrance easiness is one aspect indicating facial hair shaving easiness. The facial hair entrance easiness indicates how easily the facial hair enters the inner blade internal space 44. A distance XB, between an end surface of the second skin guard 162B and the outer blade 21, largely affects the facial hair entrance easiness. The facial hair entrance easiness increases as the distance XB increases. The favorable facial hair entrance easiness is ensured when the distance XB is within the predetermined distance range. Thus, the distance XB is set to be within the predetermined distance range.

The width XA and the distance XB affect each other. Thus, the width XA and the distance XB are preferably set based on the skin entry restriction function and the facial hair entrance easiness. The skin guard 160B has the width XA ensuring the preferably skin entry restriction function and the distance XB ensuring the preferable facial hair entrance easiness. When the width of the first skin guard 161B is assumed to be the width XA from a distal end portion to a base end portion, the first skin guard 161B may have a relatively low rigidity. Thus, in the assumed configuration, the maximum external load that can be received by the first skin guard 161B is relatively small.

Thus, the first skin guard 161B has a configuration of ensuring a preferable rigidity in addition to the configuration of ensuring the preferable skin entry restriction function and facial hair entrance easiness. If the first skin guard 161B receives a load when contacting the skin, the first skin guard 161B elastically deforms with the basal portion functioning as a fulcrum point. Thus, the first skin guard 161B is less likely to be damaged when the rigidity of the basal portion of the first skin guard 161B is increased.

The distance XB between one end surface of the second skin guard 162B and the outer blade 21 is greater than or equal to a predetermined distance. For example, the predetermined distance indicates a diameter of the facial hair that differs among persons. In the second skin guard 162B, a typical diameter of the facial hair is selected as the predetermined distance, and the distance XB is determined based on the predetermined distance thus selected. The facial hair is likely to enter the inner blade internal space 44 due to the size relationship between the second skin guard 162B and the outer blade hole 21A of the outer blade 21.

A gap space SA is formed between the first skin guard 161B and the inner blade main body wall 41. An extra space SB is formed between the second skin guard 162B and the blade piece 42. A width of the gap space SA is defined by a distance between the end surface of the first skin guard 161B and the inner blade main body wall 41. A width of the extra space SB is defined by a distance between the end surface of the second skin guard 162B and the blade piece 42. The width of the extra space SB is longer than the width of the gap space SA. The width of the extra space SB is set to be such a length that the cut facial hair is less likely to be jammed between the second skin guard 162B and the blade piece 42.

The electric shaver 1 according to the eleventh embodiment has the following advantage in addition to advantages (1) to (3).

(11) In the electric shaver 1, the second skin guard 162B is located in the inner blade internal space 44 corresponding to the inner blade hole 43 in the lateral high pressure portion RZA. Thus, the skin is less likely to enter the inner blade internal space 44 corresponding to the lateral high pressure portion RZA. Accordingly, the skin is less likely to be strongly irritated.

Twelfth Embodiment

Figure 23:
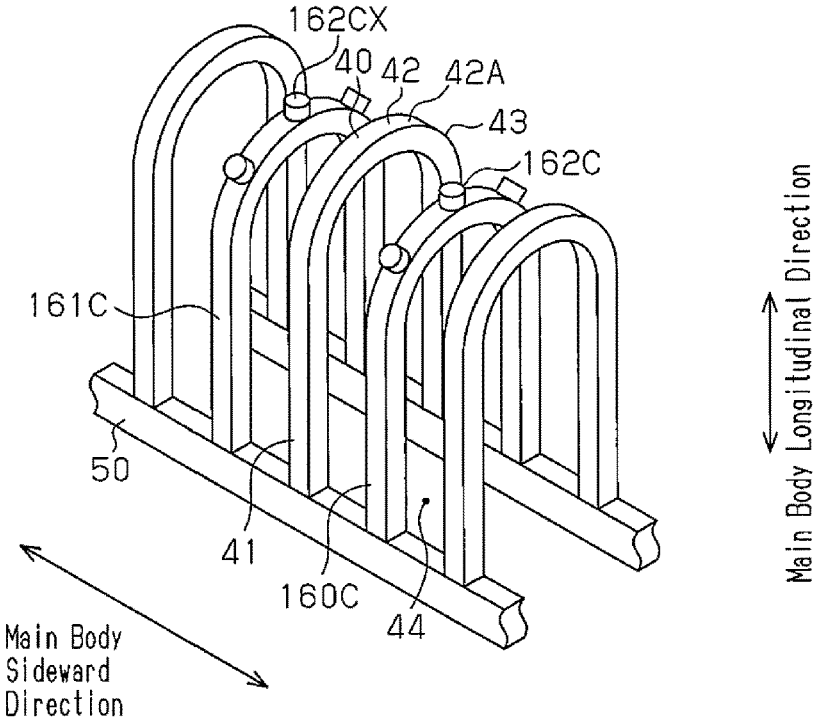
FIG. 23 is a perspective view of an inner blade unit according to a twelfth embodiment.

An electric shaver 1 according to a twelfth embodiment includes a skin guard 160C illustrated in FIG. 23 instead of the skin guard 60 according to the first embodiment. Components of the electric shaver 1 according to the twelfth embodiment that are the same as those in the electric shaver 1 according to the first embodiment are denoted with the same reference numerals, and the description thereof is partially or entirely omitted.

The configuration of the skin guard 160C will now be described with reference to FIG. 23. In FIG. 23, only a part of the inner blade unit 30 in the main body sideward direction is illustrated for the sake of description.

The skin guard 160C is located at a position in the inner blade internal space 44 corresponding to the inner blade hole 43. The skin guards 160C are located at positions respectively corresponding to the inner blade holes 43 in the main body sideward direction, that is, the longitudinal direction of the inner blade joint component 50. The skin guard 160C includes a guard base 161C and a guard contact portion 162C.

The guard base 161C, the inner blade joint component 50, and the inner blade 40 are integrally formed from the same material. The guard base 161C has a shape that is similar to that of the inner blade 40. For example, the guard base 161C has an arch shape.

The guard contact portion 162C and the guard base 161C are integrally formed from the same material. The guard contact portion 162C has a shape that extends from the guard base 161C toward the inner blade hole 43. The guard contact portion 162C comes into contact with the skin that enters the inner blade internal space 44 through the inner blade hole 43. A distal end surface 162CX of the guard contact portion 162C is located toward the inner blade internal space side from the distal end surface 42A of the blade piece 42 in the main body longitudinal direction.

The electric shaver 1 according to the twelfth embodiment has the following advantages in addition to advantages (1) to (3).

(12) The shape of the guard base 161C is similar to that of the inner blade 40. Thus, the distal end surface 162CX of the guard contact portion 162C can be more accurately positioned with respect to the distal end surface 42A of the blade piece 42 in the main body longitudinal direction.

(13) The guard base 161C, the inner blade joint component 50, and the inner blade 40 are integrally formed from the same material. Thus, the distal end surface 162CX of the guard contact portion 162C can be more accurately positioned with respect to the distal end surface 42A of the blade piece 42 in the main body longitudinal direction.

Thirteenth Embodiment

Figure 24:
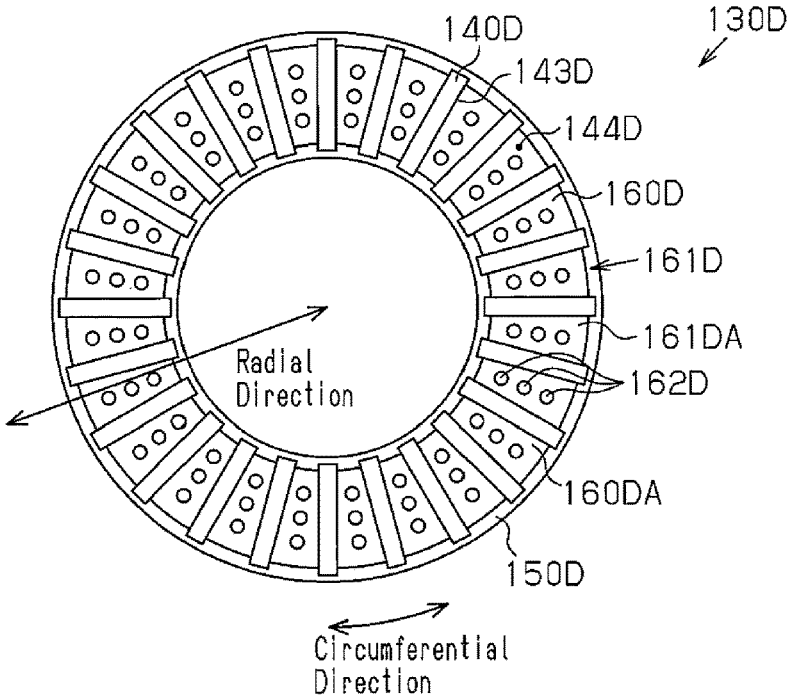
FIG. 24 is a plan view of an inner blade unit according to a thirteenth embodiment.

An electric shaver 1 according to a thirteenth embodiment includes an inner blade unit 130D illustrated in FIG. 24 instead of the inner blade unit 30 according to the first embodiment. Components of the electric shaver 1 according to the thirteenth embodiment that are the same as those in the electric shaver 1 according to the first embodiment are denoted with the same reference numerals, and the description thereof is partially or entirely omitted.

The configuration of the inner blade unit 130D will now be described with reference to FIG. 24.

The inner blade unit 130D includes an inner blade 140D and a skin guard 160D. The inner blade unit 130D has a rotary configuration in which the inner blade 140D rotates with respect to an outer blade (not illustrated) to cut facial hair drawn through the outer blade. A plurality of the inner blades 140D are spaced apart in a circumference direction of a circular inner blade joint component 150D.

The skin guard 160D has a skin entry restriction function. The skin guard 160D includes a guard base 161D and a plurality of guard contact portions 162D. A single guard contact portion 162D and a guard base 161DA serving as a part of the guard base 161D supporting the guard contact portion 162D form a skin guard 160DA as a basic element of the skin guard 160D. The skin guards 160DA are arranged in the circumference direction and a radial direction. The guard bases 161DA of the adjacent skin guards 160DA are coupled with each other to form the guard base 161D. The guard bases 161DA of the plurality of skin guards 160DA are coupled with each other. This forms a single skin guard 160D that is larger than each skin guard 160DA. Each of the plurality of skin guards 160DA are located in correspondence with a different inner blade hole 143D. The plurality of skin guards 160DA respectively correspond to all of the inner blade holes 143D.

For example, three guard contact portions 162D are arranged in the radial direction in each inner blade internal space 144D. The circumference direction of the inner blade unit 130D corresponds to the main body sideward direction of the reciprocating inner blade unit 30 (see FIG. 1 and the like). The radial direction of the inner blade unit 130D corresponds to the main body depth direction of the reciprocating inner blade unit 30 (see FIG. 1 and the like).

The electric shaver 1 according to the thirteenth embodiment provides advantages (1) to (3).

Other Embodiments

The disclosed electric shaver includes other embodiments that differ from the first embodiment to the thirteenth embodiment. The other embodiments include the following modifications, for example. The modifications and the embodiments can be combined with each other as long as there is no technical contradiction.

The guard base 61 according to the first embodiment is coupled to the inner blade joint component 50. However, the configuration of the guard base 61 is not limited to the example in the first embodiment. A guard base according to a modification is coupled to the inner blade main body wall 41.

The skin guard 60 according to the first embodiment has the configuration in which the guard base 61 and the guard contact portion 62 are integrally formed from the same material. The configuration of the skin guard 60 is not limited to the example in the first embodiment. The skin guard according to a modification has a configuration in which a guard base and a guard contact portion are integrally formed with the same elastic material.

The skin guard 60 according to the first embodiment has the guard contact portion 62 that comes into contact with the skin 100. However, the configuration of the skin guard 60 is not limited to the example in the first embodiment. A skin guard according to a modification blows air to the skin 100 that has entered through the outer blade hole 21A and the inner blade hole 43 to prevent the skin 100 from entering the inner blade internal space 44.

The guard base 61 according to the first embodiment, the guard base 361 according to the third embodiment, and the guard base 761 according to the seventh embodiment are coupled to the inner blade joint component 50. However, the configuration of the guard base is not limited to the example in the first embodiment, the third embodiment, and the seventh embodiment. A guard base according to a modification and the inner blade joint component 50 are integrally formed.

The guard base 61 according to the first embodiment, the guard base 261 according to the second embodiment, the guard base 361 according to the third embodiment, and the guard base 761 according to the seventh embodiment have the rectangular parallelepiped shape. However, the shape of the guard base is not limited to the example in the first embodiment, the second embodiment, the third embodiment, and the seventh embodiment. A guard base according to a modification has any shape such as a cube.

The guard contact portion 62 according to the first embodiment, the guard contact portion 262 according to the second embodiment, the guard contact portion 362 according to the third embodiment, the rotating portion 662 according to the sixth embodiment, and the rotating portion 763 according to the seventh embodiment are located toward the inner blade internal space side from the distal end surface 42A of the blade piece 42. However, the configurations of the guard base and the rotating portion are not limited to the example in the first embodiment, the second embodiment, the third embodiment, the sixth embodiment, and the seventh embodiment. A guard base and a rotating portion according to a modification are positioned on the same plane as the distal end surface 42A of the blade piece 42.

The electric shaver 1 according to the third embodiment includes the pressing force detector 370. However, the configuration of the electric shaver 1 is not limited to the configuration exemplified in the third embodiment. An electric shaver 1 according to a modification includes the skin-entry amount detector 470 according to the fourth embodiment in addition to the pressing force detector 370. A control unit of the electric shaver according to the modification moves the position of the distal end of the guard contact portion 362 toward the inner blade hole 43, when at least one of the skin-entry amount and the pressing force increases. More specifically, the skin pushback force of the skin guard 360 is increased.

The pressure sensor is used as the pressing force detector 370 according to the third embodiment. However, the configuration of the pressing force detector 370 is not limited to the configuration exemplified in the third embodiment. A strain gauge is used as the pressing force detector 370 according to a modification.

The oscillator 500 according to the fifth embodiment oscillates the skin guard 260 in the main body longitudinal direction. However, the configuration of the oscillator 500 is not limited to the configuration exemplified in the fifth embodiment. An oscillator according to a modification oscillates the skin guard 260 in at least one of the main body sideward direction and the main body depth direction.

The skin guard 660 according to the sixth embodiment includes the rotational shaft 661. The rotational shaft 661 has a shape that extends in the main body sideward direction in the inner blade internal space 44. However, the configuration of the rotational shaft 661 is not limited to the configuration exemplified in the sixth embodiment. A skin guard according to a modification has a rotational shaft extending in the main body depth direction in the inner blade internal space 44.

The rotating portion 662 according to the sixth embodiment and the rotating portion 763 according to the seventh embodiment are formed from a resin material. The configuration of the rotating portion is not limited to the example in the sixth embodiment and the seventh embodiment. A rotating portion according to a modification is formed from a metal material.

Figure 25:
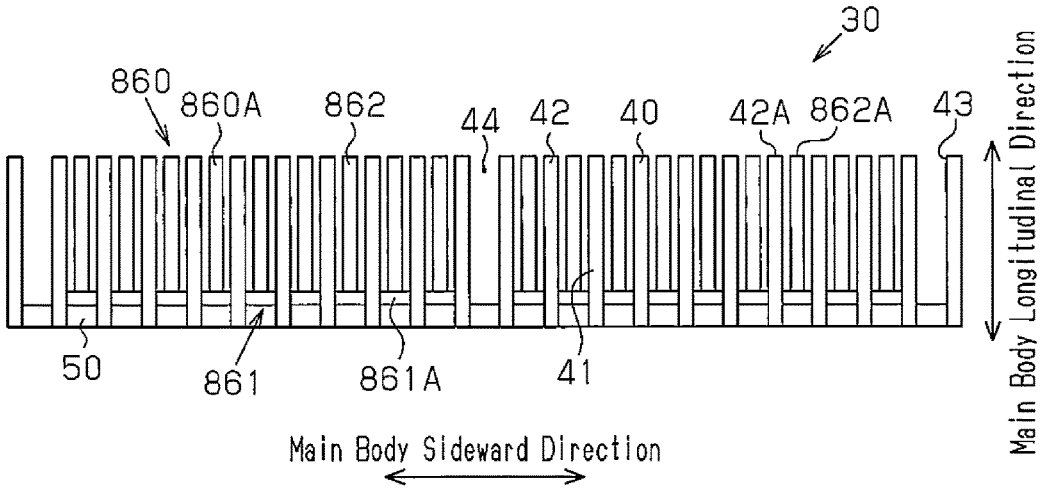
FIG. 25 is a front view of an inner blade unit according to another embodiment.
Figure 26:
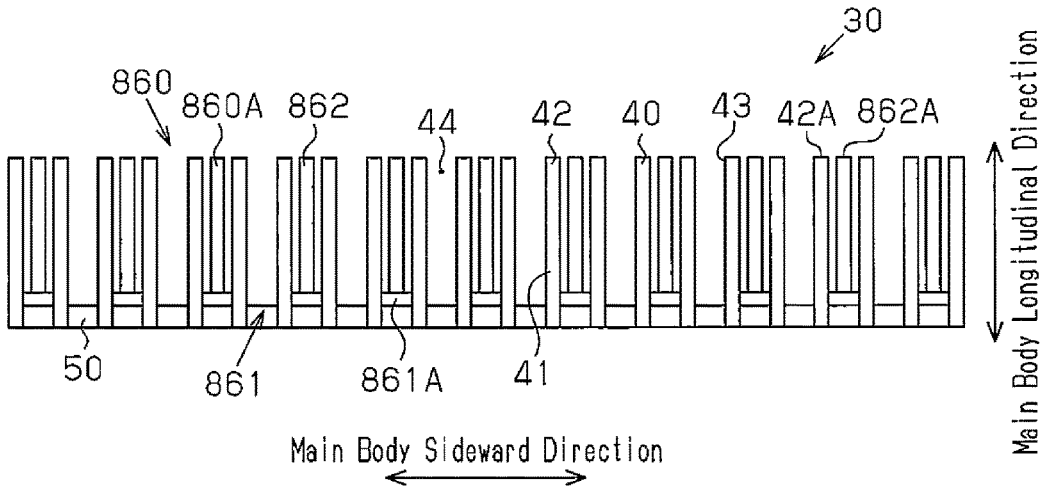
FIG. 26 is a front view of an inner blade unit according to yet another embodiment.
Figure 27:
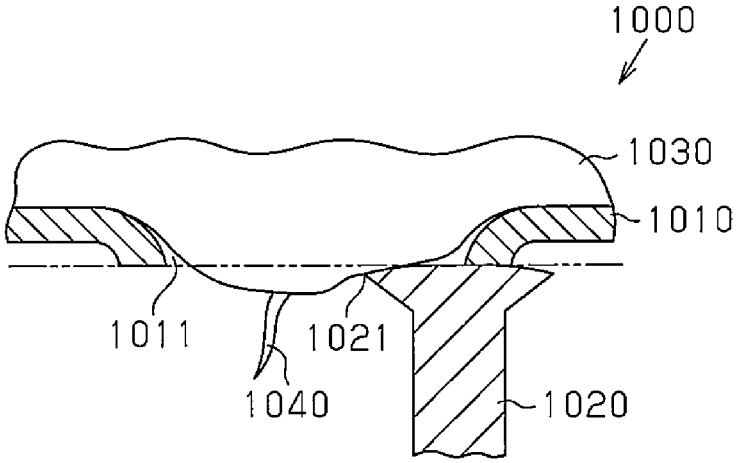
FIG. 27 is a cross-sectional view of conventional inner and outer blades.

The skin guards 860A are preferably located at positions respectively corresponding to all the inner blade holes 43 in the inner blade internal spaces 44, as in the eighth embodiment. However, the positions at which the skin guards 860A are located are not limited to the configuration exemplified in the eighth embodiment. The skin guard 860A may not be located at a position corresponding to some of the inner blade holes 43 in the inner blade internal space 44 as in modifications illustrated in FIG. 25 and FIG. 26.

In the skin guard 860A according to the eighth embodiment, the position of the distal end surface 862A of the guard contact portion 862 in the main body longitudinal direction substantially matches the position of the distal end surface 42A of the blade piece 42. However, the position of the distal end surface 862A is not limited to the position exemplified in the embodiment. A distal end surface of a contact portion guard according to a modification is located between the distal end surface 42A of the inner blade 40 and the outer blade 21.

Generally, when curly facial hair with a bent distal end enters an outer blade hole (not illustrated), the distal end may not reach the inner blade hole 43. In the modification, the distal end surface of the contact portion guard is located between the distal end surface 42A of the inner blade 40 and the outer blade 21, and thus the distal end of the curly facial hair may come into contact with the guard contact portion. Thus, the guard contact portion can straighten the facial hair. Thus, the distal end of the curly facial hair can enter the inner blade hole 43. All things considered, the shaving performance of the electric shaver 1 can be improved.

The inner blade units 30 according to the first embodiment to the twelfth embodiment move back and forth relative to the outer blade unit 20 in the main body sideward direction. However, the configuration of the inner blade unit 30 is not limited to the configurations exemplified in the first embodiment to the seventh embodiment. An inner blade unit according to a modification rotates relative to the outer blade unit 20. More specifically, an electric shaver according to a modification has a configuration of what may be referred to as a rotary electric shaver.

The electric shavers 1 according to the first embodiment to the thirteenth embodiment cut the facial hair. However, an object to be cut by the electric shaver 1 is not limited to the facial hair. An electric shaver according to a modification cuts various types of hair including the facial hair.

The electric shavers 1 according to the first embodiment to the twelfth embodiment each include two inner blade units. The number of inner blade units is not limited to the example in the first embodiment to the twelfth embodiment. An electric shaver according to a modification includes one or three or more inner blade units.

DESCRIPTION OF REFERENCE CHARACTERS

1 . . . electric shaver, 10 . . . shaver main body, 10A . . . main body front surface, 10B . . . main body back surface, 10C . . . main body right surface, 10D . . . main body left surface, 11 . . . grip, 12 . . . head, 13 . . . oscillation unit, 14 . . . power switch, 20 . . . outer blade unit, 21 . . . outer blade, 21A . . . outer blade hole, 22 . . . outer blade casing, 30 . . . inner blade unit, 40 . . . inner blade, 41 . . . inner blade main body wall, 42 . . . blade piece, 42A . . . distal end surface, 43 . . . inner blade hole, 44 . . . inner blade internal space, 50 . . . inner blade joint component, 60 . . . skin guard 60A . . . skin guard, 61 . . . guard base, 61A . . . guard base, 62 . . . guard contact portion, 62A . . . openings, 100 . . . skin, 110 . . . facial hair, 260 . . . skin guard, 261 . . . guard base, 262 . . . guard contact portion, 262A . . . openings, 263 . . . guard elastic portion, 360 . . . skin guard, 361 . . . guard base, 362 . . . guard contact portion, 362A . . . openings, 370 . . . pressing force detector, 380 . . . control unit, 470 . . . skin-entry amount detector, 500 . . . oscillator, 510 . . . electric motor, 511 . . . output shaft, 520 . . . cam member, 521 . . . first cam member,

522 . . . second cam member, 530 . . . guide, 660 . . . skin guard, 661 . . . rotational shaft, 662 . . . rotating portion, 760 . . . skin guard, 760A . . . skin guard, 761 . . . guard base, 761A . . . guard base, 762 . . . guard contact portion, 762A . . . openings, 762B . . . distal end recess, 763 . . . rotating portion, 763A . . . rotating spherical surface, 860 . . . skin guard, 860A . . . skin guard, 861 . . . guard base, 861A . . . guard base, 862 . . . guard contact portion, 862A . . . distal end surface, 921 . . . outer blade, 930 . . . inner blade unit, 940 . . . inner blade, 941 . . . inner blade main body wall, 942 . . . blade piece, 942A . . . distal end surface, 943 . . . inner blade hole, 944 . . . inner blade internal space, 960 . . . skin guard, 960A . . . skin guard, 961 . . . guard base, 961A . . . guard base, 962 . . . guard contact portion, 962A . . . distal end surface, 121A . . . outer blade, 130A . . . inner blade unit, 140A . . . inner blade, 141A . . . inner blade main body wall, 142A . . . blade piece, 142X . . . distal end surface, 143A . . . inner blade hole, 144A . . . inner blade internal space, 960 . . . skin guard, 961 . . . guard base, 961A . . . guard base, 962 . . . guard contact portion, 962A . . . distal end surface, 160B . . . skin guard, 161B . . . first skin guard, 162B . . . second skin guard, 160C . . . skin guard, 161C . . . guard base, 162C . . . guard contact portion, 162CX . . . distal end surface, 130D . . . inner blade unit, 140D . . . inner blade, 143D . . . inner blade hole, 144D . . . inner blade internal space, 150D . . . inner blade joint component, 160D . . . skin guard, 160DA . . . skin guard, 161D . . . guard base, 161DA . . . guard base, 162D . . . guard contact portion, 1000 . . . electric shaver, 1010 . . . outer blade, 1011 . . . outer blade hole, 1020 . . . inner blade, 1021 . . . inner blade hole, 1030 . . . skin, 1040 . . . facial hair.

The invention claimed is:

1. An electric shaver comprising:

an outer blade;

inner blades;

an inner blade joint component; and a skin guard, wherein:

the inner blades are arranged in a first direction, which is a direction in which the inner blades are driven when the electric shaver is in a shaving operation, and the inner blade have a depth in a second direction crossing the first direction and a height measured from the inner blade joint component in a third direction crossing the first and second directions, the outer blade includes an outer blade hole, each of the inner blades includes an inner blade main body wall and a blade piece, the inner blades rotate relative to the outer blade or move back and forth relative to the outer blade to cut hair drawn in through the outer blade hole, the inner blade main body wall is coupled to the inner blade joint component, an inner blade hole is formed as an opening between one blade piece and an adjacent one blade piece of the inner blades and an inner blade internal space is formed, as a lower space below the inner blade hole, by one of the inner blades having the one blade piece and an adjacent one of the inner blades having the adjacent one blade piece, the skin guard is located in the inner blade internal space at a position corresponding to the inner blade hole, the skin guard includes a first skin guard and a second skin guard, the second skin guard protruding from the first skin guard, the skin guard is coupled to the inner blade joint component in such a manner that the second skin guard of the skin guard comes into contact with the skin that enters the inner blade internal space through the inner blade hole, and each blade piece has a maximum depth in the second direction, the skin guard has a maximum depth in the second direction, and the maximum depth of the skin guard is smaller than the maximum depth of each blade piece.

2. The electric shaver according to claim 1, wherein:

the skin guard includes a guard base and a guard contact portion, the guard base is coupled to the inner blade joint component or the inner blade main body wall and supports the guard contact portion, and the guard contact portion is shaped to extend toward the inner blade hole and an end of the guard contact portion is located between a distal end of one of the inner blades and a proximal end of the one of the inner blades or is located between the outer blade and the distal end of the one of the inner blades.

3. The electric shaver according to claim 2, wherein the guard contact portion includes protrusions protruding from the guard base and a recess between the protrusions.

4. The electric shaver according to claim 2, wherein the guard contact portion is formed from an elastic material.

5. The electric shaver according to claim 1, wherein:

at least two inner blade internal spaces are formed by the inner blades, and a plurality of skin guards, each being the skin guard, are located in the at least two blade internal spaces, respectively, so that one skin guard is located in one blade internal space.

6. The electric shaver according to claim 1, wherein:

each of the inner blades includes a longitudinal high pressure portion configured to contact the skin with a first pressure, and a longitudinal low pressure portion configured to contact the skin with a second pressure lower than the first pressure by the longitudinal high pressure portion, in a longitudinal direction of the inner blade joint component, and the skin guard is located in the inner blade internal space at a position corresponding to the longitudinal high pressure portion and the skin guard is not located in the inner blade internal space at a position corresponding to the longitudinal low pressure portion.

7. The electric shaver according to claim 1, wherein the skin guard is one of a plurality of skin guards arranged in a lateral direction of the inner blade joint component in the inner blade internal space.

8. The electric shaver according to claim 1, wherein each blade piece of the inner blades has an arch shape including two end portions and a middle portion between the two end portions, the middle portion serves as a lateral high pressure portion configured to contact the skin with a first pressure, and each of the two lateral end portions serves as a lateral low pressure portion configured to contact the skin with a second pressure lower than first pressure by the lateral high pressure portion, in a lateral direction of the inner blade joint component which is the second direction; and the skin guard is located in the inner blade internal space at a position corresponding to the lateral high pressure portion and the skin guard is not located in the inner blade internal space at a position corresponding to laterally outermost ends of the lateral low pressure portion in the second direction.

9. The electric shaver according to claim 1, wherein the skin guard is formed integrally with the inner blade.

10. The electric shaver according to claim 1, wherein the first skin guard has an arch shape having two leg portions and a curved head portion, and a plurality of second skin guards are provided on the first skin guard.

11. The electric shaver according to claim 1, wherein:

each of the one of the inner blades and the adjacent one of the inner blades has a first height in the third direction, a first width in the first direction, and a first depth in the second direction, and the skin guard has a second height in the third direction less than the first height, a second width in the first direction less than the first width, and a second depth in the second direction less than the first depth.

12. The electric shaver according to claim 1, wherein the skin guard is located in the inner blade internal space at an intermediate position between the one of the inner blades and the adjacent one of the inner blades.

13. The electric shaver according to claim 1, wherein:

the first skin guard of the skin guard is an arch having a curved top surface, and the second skin guard of the skin guard is a protrusion protruding from the curved top surface of the first skin guard so that a height gap is formed between the curved top surface of the first skin guard and the second skin guard.

14. The electric shaver according to claim 1, wherein the first skin guard of the skin guard is an arch having a curved top surface, and the second skin guard is one of a plurality of second skin guards, the plurality of second skin guards being protrusions arranged on the curved top surface of the first skin guard so that a height gap is formed between the curved top surface of the first skin guard and each of the second skin guards.

* * * * *